US009394499B2

(12) United States Patent
Reid

(10) Patent No.: US 9,394,499 B2
(45) **Date of Patent: *Jul. 19, 2016**

(54) METHODS RELATING TO FUEL COMPOSITIONS

(71) Applicant: Innospec Limited, Ellesmere Port, Cheshire (GB)

(72) Inventor: Jacqueline Reid, Cymau (GB)

(73) Assignee: Innospec Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/621,606

(22) Filed: Feb. 13, 2015

(65) Prior Publication Data

US 2015/0225662 A1 Aug. 13, 2015

Related U.S. Application Data

(63) Continuation of application No. 13/202,798, filed as application No. PCT/GB2010/050322 on Feb. 25, 2010, now Pat. No. 9,085,740.

(30) Foreign Application Priority Data

Feb. 25, 2009 (GB) ..... 0903165.9

(51) Int. Cl.
*C10L 1/22* (2006.01)
*C10L 10/06* (2006.01)
(Continued)

(52) U.S. Cl.
CPC . *C10L 10/06* (2013.01); *C10L 1/22* (2013.01); *C10L 1/221* (2013.01); *C10L 1/226* (2013.01); *C10L 1/2225* (2013.01); *C10L 10/00* (2013.01);
(Continued)

(58) Field of Classification Search
CPC ..... C10L 1/221; C10L 1/22; C10L 1/2225; C10L 1/226; C10L 1/238; C10L 10/00; C10L 10/18
USPC ..... 44/415, 422, 347
See application file for complete search history.

(56) References Cited

U.S. PATENT DOCUMENTS 2,812,342 A 11/1957 Peters
3,018,250 A 1/1962 Anderson et al.
(Continued)

FOREIGN PATENT DOCUMENTS

EP 0565285 A1 10/1993
EP 1344795 A2 9/2003
(Continued)

OTHER PUBLICATIONS

International Preliminary Report on Patentability dated Aug. 30, 2011 for PCT/GB10/50322.
(Continued)

*Primary Examiner* — Cephia D Toomer
(74) *Attorney, Agent, or Firm* — Janine M. Susan; Burns & Levinson, LLP

(57) ABSTRACT

A method of removing deposits from a diesel engine, the method comprising combusting in the engine a diesel fuel composition comprising an engine cleaning additive, wherein the engine cleaning additive is the product of a Mannich reaction between: (a) an aldehyde; (b) ammonia, hydrazine or an amine; and (c) an optionally substituted phenol; wherein the or each substituent of the phenol component (c) has an average molecular weight of less than 400.

21 Claims, 5 Drawing Sheets

(51) Int. Cl.

| | |
|---|---|
| ***C10L 1/222*** | (2006.01) |
| ***C10L 1/226*** | (2006.01) |
| ***C10L 10/00*** | (2006.01) |
| ***C10L 10/18*** | (2006.01) |
| ***F02B 47/04*** | (2006.01) |
| ***F02M 65/00*** | (2006.01) |
| *C10L 1/238* | (2006.01) |
| *C10L 1/2383* | (2006.01) |
| *C10L 1/2387* | (2006.01) |

(52) U.S. Cl.

CPC ..... *C10L 10/18* (2013.01); *F02B 47/04* (2013.01); *F02M 65/008* (2013.01); *C10L 1/238* (2013.01); *C10L 1/2383* (2013.01); *C10L 1/2387* (2013.01); *C10L 2200/0259* (2013.01); *C10L 2270/026* (2013.01)

(56) References Cited

U.S. PATENT DOCUMENTS

| | | | |
|---|---|---|---|
| 3,110,673 | A | 11/1963 | Benoit, Jr. |
| 3,172,892 | A | 3/1965 | Le Suer et al. |
| 3,216,936 | A | 11/1965 | Le Suer |
| 3,219,666 | A | 11/1965 | Norman et al. |
| 3,250,715 | A | 5/1966 | Wyman |
| 3,251,853 | A | 5/1966 | Hoke |
| 3,260,671 | A | 7/1966 | Trites et al. |
| 3,272,746 | A | 9/1966 | Le Suer et al. |
| 3,310,492 | A | 3/1967 | Benoit, Jr. |
| 3,326,801 | A | 6/1967 | Schlobohm et al. |
| 3,337,459 | A | 8/1967 | Ford |
| 3,341,542 | A | 9/1967 | Le Suer et al. |
| 3,361,673 | A | 1/1968 | Stuart et al. |
| 3,405,064 | A | 10/1968 | Miller |
| 3,429,674 | A | 2/1969 | Hoke |
| 3,444,170 | A | 5/1969 | Norman et al. |
| 3,455,831 | A | 7/1969 | Davis |
| 3,455,832 | A | 7/1969 | Davis |
| 3,468,639 | A | 9/1969 | Lindstrom et al. |
| 3,576,743 | A | 4/1971 | Widmer et al. |
| 3,630,904 | A | 12/1971 | Musser et al. |
| 3,632,511 | A | 1/1972 | Liao |
| 3,778,371 | A | 12/1973 | Malec |
| 3,804,763 | A | 4/1974 | Meinhardt |
| 3,857,791 | A | 12/1974 | Marcellis et al. |
| 4,166,726 | A | 9/1979 | Harle |
| 4,171,959 | A | 10/1979 | Vartanian |
| 4,234,435 | A | 11/1980 | Meinhardt et al. |
| 4,253,980 | A | 3/1981 | Hammond et al. |
| 4,326,973 | A | 4/1982 | Hammond et al. |
| 4,338,206 | A | 7/1982 | Hammond et al. |
| 5,254,138 | A | 10/1993 | Kurek |
| 6,821,307 | B2 | 11/2004 | Caprotti et al. |
| 7,947,093 | B2 * | 5/2011 | Barton et al. ..... 44/422 |
| 2003/0029077 | A1 | 2/2003 | Jackson et al. |
| 2003/0163948 | A1 * | 9/2003 | Van Leest et al. ..... 44/347 |
| 2005/0215441 | A1 * | 9/2005 | Mackney et al. ..... 508/291 |
| 2006/0277819 | A1 | 12/2006 | Puri et al. |
| 2008/0052985 | A1 | 3/2008 | Stevenson et al. |
| 2008/0113890 | A1 | 5/2008 | Moreton et al. |

FOREIGN PATENT DOCUMENTS

| | | | |
|---|---|---|---|
| EP | 1568757 | A1 | 8/2005 |
| EP | 1612257 | A2 | 1/2006 |
| EP | 1884556 | A2 | 2/2008 |
| EP | 1887074 | A1 | 2/2008 |
| EP | 1900795 | A1 | 3/2008 |
| GB | 949981 | | 2/1964 |
| WO | 9006982 | A1 | 6/1990 |
| WO | 0009634 | A1 | 2/2000 |
| WO | 2006124438 | A1 | 11/2006 |
| WO | 2006135881 | A2 | 12/2006 |
| WO | 2007015080 | A1 | 2/2007 |
| WO | 2008027881 | A2 | 3/2008 |
| WO | 2009040583 | A1 | 2/2009 |
| WO | 2009027881 | A2 | 3/2009 |
| WO | 2009040582 | A1 | 4/2009 |

OTHER PUBLICATIONS

International Search Report dated Jul. 22, 2010 for PCT/GB10/50322.

* cited by examiner

METHODS RELATING TO FUEL COMPOSITIONS

CROSS-REFERENCE TO RELATED APPLICATIONS

This application is continuation of co-pending U.S. application Ser. No. 13/202,798, entitled METHODS RELATING TO FUEL COMPOSITIONS, which is a U.S. national stage application under 35 U.S.C. 371 of International Application No. PCT/GB10/50322, filed Feb. 25, 2010, and entitled METHODS AND USES RELATING TO FUEL COMPOSITIONS, which in turn claims priority to Great Britain Patent Application No. 0903165.9, filed Feb. 25, 2009, both of which are incorporated by reference herein in their entirety for all purposes.

FIELD OF INVENTION

The present invention relates to fuel compositions and to methods and uses relating thereto. In particular the invention relates to additives for diesel fuel compositions and the use of such additives in cleaning engines.

BACKGROUND

Due to consumer demand and legislation, diesel engines have in recent years become much more energy efficient, show improved performance and have reduced emissions.

These improvements in performance and emissions have been brought about by improvements in the combustion process. To achieve the fuel atomisation necessary for this improved combustion, fuel injection equipment has been developed which uses higher injection pressures and reduced fuel injector nozzle hole diameters. The fuel pressure at the injection nozzle is now commonly in excess of 1500 bar ($1.5\times10^8$ Pa). To achieve these pressures the work that must be done on the fuel also increases the temperature of the fuel. These high pressures and temperatures can cause degradation of the fuel.

DETAILED DESCRIPTION OF THE INVENTION

Figure 1:
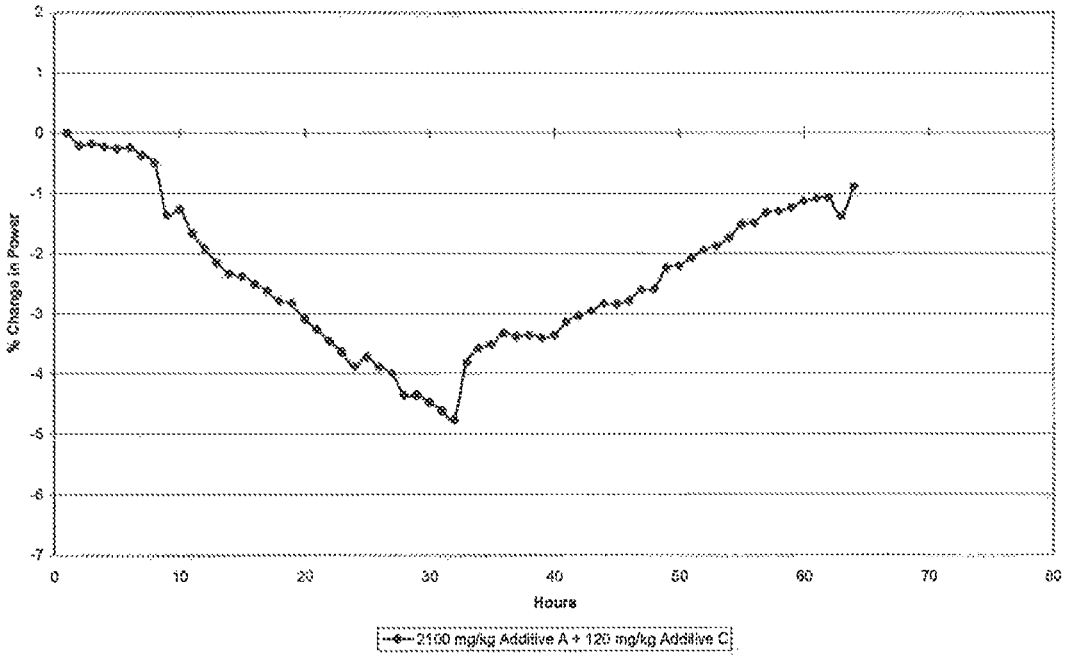
FIG. 1 is a graph showing the power output of an engine using composition 1 in an injector "clean up" test.

Diesel engines having high pressure fuel systems can include but are not limited to heavy duty diesel engines and smaller passenger car type diesel engines. Heavy duty diesel engines can include very powerful engines such as the MTU series 4000 diesel having 20 cylinder variants with power output up to 4300 kW or engines such as the Renault dXi 7 having 6 cylinders and a power output around 240 kW. A typical passenger car diesel engine is the Peugeot DW10 having 4 cylinders and a power output of 100 kW or less depending on the variant.

In all of the diesel engines relating to this invention, a common feature is a high pressure fuel system. Typically pressures in excess of 1350 bar ($1.35\times10^8$ Pa) are used but often pressures of up to 2000 bar ($2\times10^8$ Pa) or more may exist.

Two non-limiting examples of such high pressure fuel systems are: the common rail injection system, in which the fuel is compressed utilizing a high-pressure pump that supplies it to the fuel injection valves through a common rail; and the unit injection system which integrates the high-pressure pump and fuel injection valve in one assembly, achieving the highest possible injection pressures exceeding 2000 bar ($2\times10^8$ Pa). In both systems, in pressurizing the fuel, the fuel gets hot, often to temperatures around 100° C., or above.

In common rail systems, the fuel is stored at high pressure in the central accumulator rail or separate accumulators prior to being delivered to the injectors. Often, some of the heated fuel is returned to the low pressure side of the fuel system or returned to the fuel tank. In unit injection systems the fuel is compressed within the injector in order to generate the high injection pressures. This in turn increases the temperature of the fuel.

In both systems, fuel is present in the injector body prior to injection where it is heated further due to heat from the combustion chamber. The temperature of the fuel at the tip of the injector can be as high as 250-350° C.

Thus the fuel is stressed at pressures from 1350 bar ($1.35\times10^8$ Pa) to over 2000 bar ($2\times10^8$ Pa) and temperatures from around 100° C. to 350° C. prior to injection, sometimes being recirculated back within the fuel system thus increasing the time for which the fuel experiences these conditions.

A common problem with diesel engines is fouling of the injector, particularly the injector body, and the injector nozzle. Fouling may also occur in the fuel filter. Injector nozzle fouling occurs when the nozzle becomes blocked with deposits from the diesel fuel. Fouling of fuel filters may be related to the recirculation of fuel back to the fuel tank. Deposits increase with degradation of the fuel. Deposits may take the form of carbonaceous coke-like residues or sticky or gum-like residues. Diesel fuels become more and more unstable the more they are heated, particularly if heated under pressure. Thus diesel engines having high pressure fuel systems may cause increased fuel degradation.

The problem of injector fouling may occur when using any type of diesel fuels. However, some fuels may be particularly prone to cause fouling or fouling may occur more quickly when these fuels are used. For example, fuels containing biodiesel have been found to produce injector fouling more readily. Diesel fuels containing metallic species may also lead to increased deposits. Metallic species may be deliberately added to a fuel in additive compositions or may be present as contaminant species. Contamination occurs if metallic species from fuel distribution systems, vehicle distribution systems, vehicle fuel systems, other metallic components and lubricating oils become dissolved or dispersed in fuel.

Transition metals in particular cause increased deposits, especially copper and zinc species. These may be typically present at levels from a few ppb (parts per billion) up to 50 ppm, but it is believed that levels likely to cause problems are from 0.1 to 50 ppm, for example 0.1 to 10 ppm.

When injectors become blocked or partially blocked, the delivery of fuel is less efficient and there is poor mixing of the fuel with the air. Over time this leads to a loss in power of the engine, increased exhaust emissions and poor fuel economy.

As the size of the injector nozzle hole is reduced, the relative impact of deposit build up becomes more significant. By simple arithmetic a 5 μm layer of deposit within a 500 μm hole reduces the flow area by 4% whereas the same 5 μm layer of deposit in a 200 μm hole reduces the flow area by 9.8%.

Additives which reduce the formation of deposits in an engine are known. It would be desirable to provide an additive for diesel fuels which would help clean up deposits that have already formed in an engine, in particular deposits which have formed on the injectors.

The present inventors have now found a fuel composition which when combusted in a diesel engine removes deposits therefrom thus effecting the "clean-up" of an already fouled engine.

"Clean-up" of a fouled engine may provide significant advantages. For example superior clean up may lead to an increase in power and/or an increase in fuel economy. In addition removal of deposits from an engine, in particular from injectors may lead to an increase in interval time before injector maintenance or replacement is necessary thus reducing maintenance costs.

According to a first aspect of the present invention there is provided a method of removing deposits from a diesel engine, the method comprising combusting in the engine a diesel fuel composition comprising an engine cleaning additive, wherein the engine cleaning additive is the product of a Mannich reaction between:

(a) an aldehyde;

(b) ammonia, hydrazine or an amine; and (c) an optionally substituted phenol;

wherein the or each substituent of the phenol component (c) has an average molecular weight of less than 400.

Any aldehyde may be used as aldehyde component (a). Preferably the aldehyde component (a) is an aliphatic aldehyde. Preferably the aldehyde has 1 to 10 carbon atoms, preferably 1 to 6 carbon atoms, more preferably 1 to 3 carbon atoms. Most preferably the aldehyde is formaldehyde.

Component (b) may be selected from ammonia, hydrazine or an amine. It may be a monoamine, for example an optionally substituted alkyl amine. Preferred amines include C1 to C4 primary amines, for example methylamine, and secondary amines.

In preferred embodiments component (b) comprises a polyamine, that is a compound including two or more amine groups.

In such embodiments, polyamine component (b) may be selected from any compound including two or more amine groups. Preferably the polyamine is a polyalkylene polyamine. Preferably the polyamine is a polyalkylene polyamine in which the alkylene component has 1 to 6, preferably 1 to 4, most preferably 2 to 3 carbon atoms. Most preferably the polyamine is a polyethylene polyamine.

Preferably the polyamine has 2 to 15 nitrogen atoms, preferably 2 to 10 nitrogen atoms, more preferably 2 to 8 nitrogen atoms.

In especially preferred embodiments, polyamine component (b) includes the moiety $R^1R^2NCHR^3CHR^4NR^5R^6$ wherein each of $R^1$, $R^2$, $R^3$, $R^4$, $R^5$ and $R^6$ is independently selected from hydrogen, and an optionally substituted alkyl, alkenyl, alkynyl, aryl, alkylaryl or arylalkyl substituent.

Thus the polyamine reactants used to make the Mannich reaction products used as the engine cleaning additive in the method of the present invention preferably include an optionally substituted ethylene diamine residue.

Preferably at least one of $R^1$ and $R^2$ is hydrogen. Preferably both of $R^1$ and $R^2$ are hydrogen.

Preferably at least two of $R^1$, $R^2$, $R^5$ and $R^6$ are hydrogen.

Preferably at least one of $R^3$ and $R^4$ is hydrogen. In some preferred embodiments each of $R^3$ and $R^4$ is hydrogen. In some embodiments $R^3$ is hydrogen and $R^4$ is alkyl, for example $C_1$ to $C_4$ alkyl, especially methyl.

Preferably at least one of $R^5$ and $R^6$ is an optionally substituted alkyl, alkenyl, alkynyl, aryl, alkylaryl or arylalkyl substituent.

In embodiments in which at least one of $R^1$, $R^2$, $R^3$, $R^4$, $R^5$ and $R^6$ is not hydrogen, each is independently selected from an optionally substituted alkyl, alkenyl, alkynyl, aryl, alkylaryl or arylalkyl moiety. Preferably each is independently selected from hydrogen and an optionally substituted C(1-6) alkyl moiety.

In particularly preferred compounds each of $R^1$, $R^2$, $R^3$, $R^4$ and $R^5$ is hydrogen and $R^6$ is an optionally substituted alkyl, alkenyl, alkynyl, aryl, alkylaryl or arylalkyl substituent. Preferably $R^6$ is an optionally substituted C(1-6) alkyl moiety.

Such an alkyl moiety may be substituted with one or more groups selected from hydroxyl, amino (especially unsubstituted amino; —NH—, —$NH_2$), sulpho, sulphoxy, C(1-4) alkoxy, nitro, halo (especially chloro or fluoro) and mercapto.

There may be one or more heteroatoms incorporated into the alkyl chain, for example O, N or S, to provide an ether, amine or thioether.

Especially preferred substituents $R^2$, $R^3$, $R^4$, $R^5$ or $R^6$ are hydroxy-C(1-4)alkyl and amino-(C(1-4)alkyl, especially HO—$CH_2$—$CH_2$— and $H_2N$—$CH_2$—$CH_2$—.

Suitably the polyamine includes only amine functionality, or amine and alcohol functionalities.

The polyamine may, for example, be selected from ethylenediamine, diethylenetriamine, triethylenetetramine, tetraethylenepentamine, pentaethylenehexamine, hexaethyleneheptamine, heptaethyleneoctamine, propane-1,2-diamine, 2(2-amino-ethylamino)ethanol, and $N^1$,$N^1$-bis(2-aminoethyl)ethylenediamine ($N(CH_2CH_2NH_2)_3$). Most preferably the polyamine comprises tetraethylenepentamine or especially ethylenediamine.

Commercially available sources of polyamines typically contain mixtures of isomers and/or oligomers, and products prepared from these commercially available mixtures fall within the scope of the present invention.

The polyamines used to form the engine cleaning additive of the present invention may be straight chained or branched and may include cyclic structures.

Optionally substituted phenol component (c) may be substituted with 0 to 4 groups on the aromatic ring (in addition to the phenol OH). For example it may be a tri- or di-substituted phenol. Most preferably component (c) is a mono-substituted phenol. Substitution may be at the ortho, and/or meta, and/or para position(s).

Each phenol moiety may be ortho, meta or para substituted with the aldehyde/amine residue. Compounds in which the aldehyde residue is ortho or para substituted are most commonly formed. Mixtures of compounds may result. In preferred embodiments the starting phenol is para substituted and thus the ortho substituted product results.

The phenol may be substituted with any common group, for example one or more of an alkyl group, an alkenyl group, an alkynl group, a nitryl group, a carboxylic acid, an ester, an ether, an alkoxy group, a halo group, a further hydroxyl group, a mercapto group, an alkyl mercapto group, an alkyl sulphoxy group, a sulphoxy group, an aryl group, an arylalkyl group, a substituted or unsubstituted amine group or a nitro group.

Preferably the phenol carries one or more optionally substituted alkyl substituents. The alkyl substituent may be optionally substituted with, for example, hydroxyl, halo, (especially chloro and fluoro), alkoxy, alkyl, mercapto, alkyl sulphoxy, aryl or amino residues. Preferably the alkyl group consists essentially of carbon and hydrogen atoms. The substituted phenol may include a alkenyl or alkynyl residue including one or more double and/or triple bonds. Most preferably the component (c) is an alkyl substituted phenol group in which the alkyl chain is saturated. The alkyl chain may be linear or branched.

Preferably component (c) is a monoalkyl phenol, especially a para-substituted monoalkyl phenol.

Preferably component (c) comprises an alkyl substituted phenol in which the phenol carries one or more alkyl chains having a total of less 28 carbon atoms, preferably less than 24 carbon atoms, more preferably less than 20 carbon atoms, preferably less than 18 carbon atoms, preferably less than 16 carbon atoms and most preferably less than 14 carbon atoms.

Preferably the or each alkyl substituent of component (c) has from 4 to 20 carbons atoms, preferably 6 to 18, more preferably 8 to 16, especially 10 to 14 carbon atoms. In a particularly preferred embodiment, component (c) is a phenol having a C12 alkyl substituent.

In some embodiments, component (c) may include a C1 to C4 alkyl substituent, for example a methyl substituent. Thus component (c) may be derived from a methyl phenol component (i.e. cresol). In such embodiments ortho-cresol derived compounds are preferred. Component (c) may comprise cresol itself, for example ortho-cresol or it may be further substituted. Suitable compounds include para-substituted ortho-cresol compounds, for example para-dodecyl ortho-methyl phenol.

In preferred embodiments, the or each substituent of phenol component (c) has a molecular weight of less than 350, preferably less than 300, more preferably less than 250 and most preferably less than 200. The or each substituent of phenol component (c) may suitably have a molecular weight of from 100 to 250, for example 150 to 200.

Molecules of component (c) preferably have a molecular weight on average of less than 1800, preferably less than 800, preferably less than 500, more preferably less than 450, preferably less than 400, preferably less than 350, more preferably less than 325, preferably less than 300 and most preferably less than 275.

As detailed above, component (b) may be selected from ammonia, hydrazine and an amine. In some embodiments, the engine cleaning additive of the present invention may be an oligomeric or polymeric compound.

The skilled person will appreciate that polymeric species typically include a mixture of molecules of varying chain length distributed around an average chain length. Preferably when the engine cleaning additive of the present invention is a polymeric or an oligomeric species, it includes an average of from 1 to 50 repeat units, preferably from 1 to 20 repeat units, more preferably from 1 to 10 repeat units.

Preferably the engine cleaning additive has a number average molecular weight of less than 10000, preferably less than 7500, preferably less than 2000, more preferably less than 1500.

Suitably the number average molecular weight of the engine cleaning additive is from 300 to 2000, preferably from 300 to 1500, more preferably from 400 to 1300.

Preferably the engine cleaning additive has a molecular weight of less than 900, more preferably less than 850 and most preferably less than 800.

Components (a), (b) and (c) may each comprise a mixture of compounds and/or a mixture of isomers.

The engine cleaning additive of the present invention is preferably the reaction product obtained by reacting components (a), (b) and (c) in a molar ratio of from 10:1:10 to 0.1:1:0.1, preferably from 5:1:5 to 0.1:1:0.1, more preferably from 3:1:3 to 0.5:1:0.5.

In some embodiments in which component (b) is ammonia and the engine cleaning additive is a polymer, the ratio of components (a):(b):(c) used to prepare the additive is approximately 2:1:1.

In preferred embodiments, to form the engine cleaning additive of the present invention components (a) and (b) are preferably reacted in a molar ratio of from 4:1 to 1:1, suitably from 3:1 to 1:1 (aldehyde:ammonia/hydrazine/amine), preferably from 2:1 to 1:1.

To form a preferred engine cleaning additive of the present invention the molar ratio of component (a) to component (c) in the reaction mixture is preferably at least 0.75:1, preferably from 0.75:1 to 4:1, preferably 1:1 to 4:1, more preferably from 1:1 to 2:1. There may be an excess of aldehyde. In preferred embodiments the molar ratio of component (a) to component (c) is approximately 1:1, for example from 0.8:1 to 1.5:1 or from 0.9:1 to 1.25:1.

To form a preferred engine cleaning additive of the present invention the molar ratio of component (c) to component (b) in the reaction mixture used to prepare the engine cleaning additive is suitably at least 1.2:1, for example at least 1.3:1 or at least 1.4:1. In some embodiments it may be at least 1.5:1, preferably at least 1.6:1, more preferably at least 1.7:1, for example at least 1.8:1, or at least 1.9:1. The molar ratio of component (c) to component (b) may be up to 5:1; for example it may be up to 4:1, or up to 3.5:1. Suitably it is up to 3.25:1, up to 3:1, up to 2.5:1, up to 2.3:1 or up to 2.1:1.

Some preferred compounds for use in the present invention are typically formed by reacting components (a), (b) and (c) in a molar ratio of 2 parts (a) to 1 part (b) ±0.2 parts (b), to 2 parts (c) ±0.4 parts (c); preferably approximately 2:1:2 (a:b:c).

In other preferred embodiments the engine cleaning additive is formed by reacting components (a), (b), (c) in a molar ratio of 1 part (a) to 1 part (b) ±0.2 parts (b) to 1 part (c) ±0.2 parts (c); preferably approximately 1:1:1 (a:b:c).

In other preferred embodiments the engine cleaning additive is formed by reacting components (a), (b) and (c) in a molar ratio of 2 parts (a) to 1 part (b) ±0.2 parts (b) to 1.5 parts (c) ±0.2 parts (c); preferably approximately 2:1:1.5 (a:b:c).

The skilled person would appreciate that the Mannich reaction products of the engine cleaning additive of the present invention are complex mixtures of products resulting from the reaction of different ratios of components (a), (b) and (c). Mixtures of isomers may also be present.

The engine cleaning additives of the present invention may comprise compounds having a variety of structures. For example it may include compounds defined by the general formula II

II

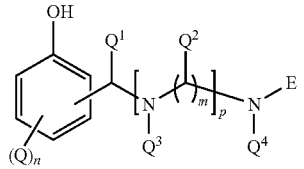

where E represents a hydrogen atom or a group of formula

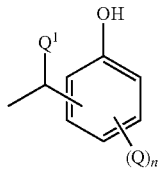

It may include compounds of formula III:

III

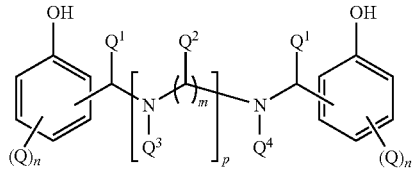

It may include compounds of formula V

V

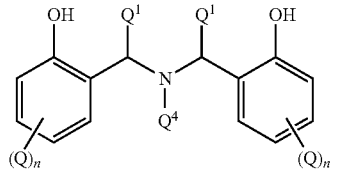

It may include compounds of formula VI

VI

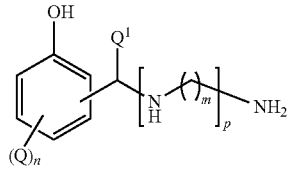

It may include compounds of formula (VII):

VII

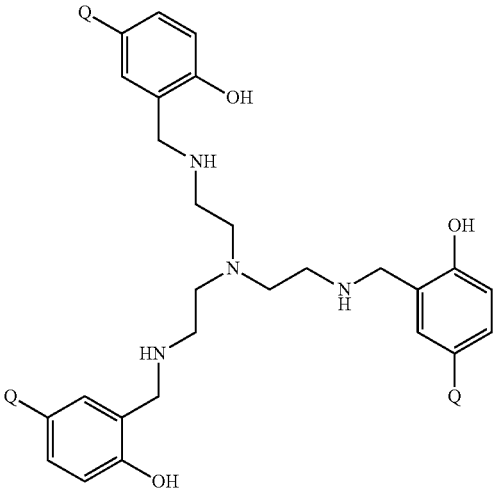

In structures II to VII above the/each Q is independently selected from an optionally substituted alkyl group, $Q^1$ is a residue from the aldehyde component, m is from 0 to 6, n is from 0 to 4, p is from 0 to 12, $Q^2$ is selected from hydrogen and an optionally substituted alkyl group, $Q^3$ is selected from hydrogen and an optionally substituted alkyl group, and $Q^4$ is selected from hydrogen, $NH_2$ and an optionally substituted alkyl group; for example an amino-substituted alkyl group.

n may be 0, 1, 2, 3, or 4. Preferably n is 1 or 2, most preferably 1.

m is preferably 0, 2 or 3 but may be larger and the alkylene group may be straight chained or branched. Most preferably m is 2.

Q is preferably an optionally substituted alkyl group having up to 30 carbons. Q may be substituted with halo, hydroxy, amino, sulphoxy, mercapto, nitro, aryl residues or may include one or more double bonds. Preferably Q is a simple alkyl group consisting essentially of carbon and hydrogen atoms and is predominantly saturated. Q preferably has 5 to 20, more preferably 10 to 15 carbon atoms. Most preferably Q is an alkyl chain of 12 carbon atoms.

$Q^1$ may be any suitable group. It may be selected from an aryl, alkyl, or alkynyl group optionally substituted with halo, hydroxy, nitro, amino, sulphoxy, mercapto, alkyl, aryl or alkenyl. Preferably $Q^1$ is hydrogen or an optionally substituted alkyl group, for example an alkyl group having 1 to 4 carbon atoms. Most preferably $Q^1$ is hydrogen.

Preferably p is from 0 to 7, more preferably from 0 to 6, most preferably from 0 to 4.

When a group $Q^2$ is not hydrogen, it may be a straight chained or branched alkyl group. The alkyl group may be optionally substituted. Such an alkyl group may typically include one or more amino and/or hydroxyl substituents.

When $Q^3$ is not hydrogen, it may be a straight chained or branched alkyl group. The alkyl group may be optionally substituted. Such an alkyl group may typically include one or more amino and/or hydroxyl substituents.

In some embodiments $Q^4$ may be a straight chained or branched alkyl group. The alkyl group may be optionally substituted. Such an alkyl group may typically include one or more amino and/or hydroxyl substituents. In some preferred embodiments, p is 0 and $Q^4$ is an amino-substituted alkyl group, for example the residue of a polyamine, as defined herein as component (b).

The skilled person would appreciate that the Mannich reaction products of the engine cleaning additive of the present invention are complex mixtures of products. In particular—the skilled person would understand that mixtures of isomers of the above products may be present.

In some preferred embodiments the engine cleaning additive may include oligomers and polymers resulting from the reaction of components (a), (b) and (c). These may include molecules having the formulae shown in figure VIII

VIII

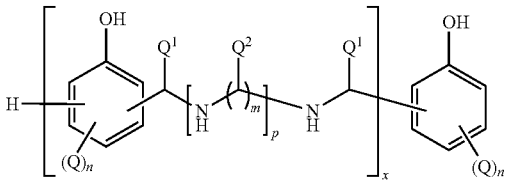

wherein Q, $Q^1$, $Q^2$, n, m and p are as described above and x is from 1 to 12, for example from 1 to 8, more preferably from 1 to 4.

According to a second aspect of the present invention there is provided a diesel fuel composition for use in the method of the first aspect. Preferred features of the second aspect are as defined in relation to the first aspect.

The engine cleaning additive is preferably present in the diesel fuel composition in an amount of at least 5 ppm, preferably at least 10 ppm, more preferably at least 20 ppm, for example at least 30 ppm, at least 40 ppm or at least 50 ppm. In some embodiments the engine cleaning additive is present in an amount of at least 100 ppm, for example at least 105 ppm, at least 110 ppm or at least 120 ppm.

The engine cleaning additive may be present in an amount of up to 20000 ppm, for example up to 10000 ppm, suitably up to 8000 ppm, preferably up to 6000 ppm, for example up to 5000 ppm.

Suitably the additive may be present in an amount from 100 to 800 ppm, for example 200 to 500 ppm.

Suitably the additive may be present in an amount of from 300 to 1000 ppm, for example 400 to 800 ppm.

Suitably the additive may be present in an amount of from 500 to 2000 ppm, for example 800 to 1500 ppm.

Suitably the additive may be present in an amount of from 1000 to 3000 ppm, for example 1500 to 2500 ppm.

Suitably the engine cleaning additive may be present in an amount of from 150 to 700 ppm, for example from 180 to 600 ppm.

Suitably the engine cleaning additive may be present in an amount of from 120 to 490 ppm, for example from 125 to 475 ppm.

Suitably the engine cleaning additive may be present in an amount of 520 to 980 ppm, for example from 550 to 950 ppm or from 600 to 900 ppm.

In some embodiments the diesel fuel composition comprises two or more engine cleaning additives of the type described herein. In such embodiments, the amounts given above refer to the total amount of all such additives present in the diesel fuel composition.

As stated previously, fuels containing biodiesel or metals are known to cause fouling. Severe fuels, for example those containing high levels of metals and/or high levels of biodiesel may require higher treat rates of the engine cleaning additive than fuels which are less severe.

The engine cleaning additive may be added to the fuel as neat additive or it may first be dissolved in a diluent, for example an aromatic solvent. Alternatively it may be suspended or dissolved in a carrier and then added to the diesel fuel. The carrier will then form part of the resultant fuel composition.

Carriers for fuel additives are known to those skilled in the art and include for example polyethers, polybutenes and mineral oils. Preferred carriers for use in the present invention include polyether carriers, for example alkyl ethoxylates and alkyl propoxylates.

In some preferred embodiments the diesel fuel composition further comprises an additive comprising a quaternary ammonium salt. These "quaternary ammonium salt additives" comprise the reaction product of nitrogen containing species having at least one tertiary amine group and a quaternizing agent.

Thus the present invention may suitably provide a diesel fuel composition comprising an engine cleaning additive of the first aspect ("a Mannich additive") and a quaternary ammonium salt additive.

The nitrogen containing species having at least one tertiary amine group used to make quaternary ammonium salt additive may be selected from:

(i) the reaction product of a hydrocarbyl-substituted acylating agent and a compound comprising at least one tertiary amine group and a primary amine, secondary amine or alcohol group;

(ii) a mannich reaction product comprising a tertiary amine group; and (iii) a polyalkylene substituted amine having at least one tertiary amine group.

Examples of quaternary ammonium salt and methods for preparing the same are described in the following patents, which are hereby incorporated by reference, U.S. Pat. No. 4,253,980, U.S. Pat. No. 3,778,371, U.S. Pat. No. 4,171,959, U.S. Pat. No. 4,326,973, U.S. Pat. No. 4,338,206, and U.S. Pat. No. 5,254,138.

Component (i) may be regarded as the reaction product of a hydrocarbyl-substituted acylating agent and a compound having an oxygen or nitrogen atom capable of condensing with said acylating agent and further having a tertiary amino group.

When the nitrogen containing species includes component (i), the hydrocarbyl substituted acylating agent is preferably a mono- or polycarboxylic acid (or reactive equivalent thereof) for example a substituted succinic, phthalic or propionic acid.

The hydrocarbyl substituent in such acylating agents preferably comprises at least 8, more preferably at least 12, for example 30 or 50 carbon atoms. It may comprise up to about 200 carbon atoms. Preferably the hydrocarbyl substituent of the acylating agent has a number average molecular weight (Mn) of between 170 to 2800, for example from 250 to 1500, preferably from 500 to 1500 and more preferably 500 to 1100. An Mn of 700 to 1300 is especially preferred, for example from 700 to 1000.

Illustrative of hydrocarbyl substituent based groups containing at least eight carbon atoms are n-octyl, n-decyl, n-dodecyl, tetrapropenyl, n-octadecyl, oleyl, chloroctadecyl, triicontanyl, etc. The hydrocarbyl based substituents may be made from homo- or interpolymers (e.g. copolymers, terpolymers) of mono- and di-olefins having 2 to 10 carbon atoms, for example ethylene, propylene, butane-1, isobutene, butadiene, isoprene, 1-hexene, 1-octene, etc. Preferably these olefins are 1-monoolefins. The hydrocarbyl substituent may also be derived from the halogenated (e.g. chlorinated or brominated) analogs of such homo- or interpolymers. Alternatively the substituent may be made from other sources, for example monomeric high molecular weight alkenes (e.g. 1-tetra-contene) and chlorinated analogs and hydrochlorinated analogs thereof, aliphatic petroleum fractions, for example paraffin waxes and cracked and chlorinated analogs and hydrochlorinated analogs thereof, white oils, synthetic alkenes for example produced by the Ziegler-Natta process (e.g. poly(ethylene) greases) and other sources known to those skilled in the art. Any unsaturation in the substituent may if desired be reduced or eliminated by hydrogenation according to procedures known in the art.

The term "hydrocarbyl" as used herein denotes a group having a carbon atom directly attached to the remainder of the molecule and having a predominantly aliphatic hydrocarbon character. Suitable hydrocarbyl based groups may contain non-hydrocarbon moieties. For example they may contain up to one non-hydrocarbyl group for every ten carbon atoms provided this non-hydrocarbyl group does not significantly alter the predominantly hydrocarbon character of the group. Those skilled in the art will be aware of such groups, which include for example hydroxyl, halo (especially chloro and fluoro), alkoxyl, alkyl mercapto, alkyl sulphoxy, etc. Preferred hydrocarbyl based substituents are purely aliphatic hydrocarbon in character and do not contain such groups.

The hydrocarbyl-based substituents are preferably predominantly saturated, that is, they contain no more than one carbon-to-carbon unsaturated bond for every ten carbon-to-carbon single bonds present. Most preferably they contain no more than one carbon-to-carbon non-aromatic unsaturated bond for every 50 carbon-to-carbon bonds present.

In some preferred embodiments, the hydrocarbyl-based substituents are poly-(isobutene)s known in the art. Thus in especially preferred embodiments the hydrocarbyl substituted acylating agent is a polyisobutenyl substituted succinic anhydride.

The preparation of polyisobutenyl substituted succinic anhydrides (PIBSA) is documented in the art. Suitable processes include thermally reacting polyisobutenes with maleic anhydride (see for example U.S. Pat. No. 3,361,673 and U.S. Pat. No. 3,018,250), and reacting a halogenated, in particular a chlorinated, polyisobutene (PIB) with maleic anhydride (see for example U.S. Pat. No. 3,172,892). Alternatively, the polyisobutenyl succinic anhydride can be prepared by mixing the polyolefin with maleic anhydride and passing chlorine through the mixture (see for example GB-A-949,981).

Conventional polyisobutenes and so-called "highly-reactive" polyisobutenes are suitable for use in the invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100% of terminal vinylidene groups such as those described in EP1344785.

Other preferred hydrocarbyl groups include those having an internal olefin for example as described in the applicant's published application WO2007/015080.

An internal olefin as used herein means any olefin containing predominantly a non-alpha double bond, that is a beta or higher olefin. Preferably such materials are substantially completely beta or higher olefins, for example containing less than 10% by weight alpha olefin, more preferably less than 5% by weight or less than 2% by weight. Typical internal olefins include Neodene 1518IO available from Shell.

Internal olefins are sometimes known as isomerised olefins and can be prepared from alpha olefins by a process of isomerisation known in the art, or are available from other sources. The fact that they are also known as internal olefins reflects that they do not necessarily have to be prepared by isomerisation.

Examples of the nitrogen or oxygen containing compounds capable of condensing with the acylating agent and further having a tertiary amino group can include but are not limited to: N,N-dimethyl-aminopropylamine, N,N-diethyl-aminopropylamine, N,N-dimethyl-amino ethylamine. The nitrogen or oxygen containing compounds capable of condensing with the acylating agent and further having a tertiary amino group can further include amino alkyl substituted heterocyclic compounds such as 1-(3-aminopropyl)imidazole and 4-(3-aminopropyl)morpholine, 1-(2-aminoethyl)piperidine, 3,3-diamino-N-methyldi-propylamine, and 3'3-aminobis(N,N-dimethylpropylamine). Other types of nitrogen or oxygen containing compounds capable of condensing with the acylating agent and having a tertiary amino group include alkanolamines including but not limited to triethanolamine, trimethanolamine, N,N-dimethylaminopropanol, N,N-dimethylaminoethanol, N,N-diethylaminopropanol, N,N-diethylaminoethanol, N,N-diethylaminobutanol, N,N,N-tris(hydroxyethyl)amine, N,N,N-tris(hydroxymethyl)amine, N,N,N-tris(aminoethyl)amine, N,N-dibutylaminopropylamine and N,N,N'-trimethyl-N'-hydroxyethyl-bisaminoethylether; N, N-bis(3-dimethylaminopropyl)-N-isopropanolamine; N-(3-dimethylaminopropyl)-N,N-diisopropanolamine; N'-(3-(dimethylamino)propyl)-N,N-dimethyl 1,3-propanediamine; 2-(2-dimethylaminoethoxy)ethanol, and N,N,N'-trimethylaminoethyl-ethanolamine.

The preparation of suitable quaternary ammonium salt additives in which the nitrogen-containing species includes component (i) is described in WO 2006/135881.

Component (ii) is a Mannich reaction product having a tertiary amine. The preparation of quaternary ammonium salts formed from nitrogen-containing species including component (ii) is described in US 2008/0052985.

The Mannich reaction product having a tertiary amine group is prepared from the reaction of a hydrocarbyl-substituted phenol, an aldehyde and an amine.

The hydrocarbyl substituent of the hydrocarbyl substituted phenol can have 6 to 400 carbon atoms, suitably 30 to 180 carbon atoms, for example 10 or 40 to 110 carbon atoms. This hydrocarbyl substituent can be derived from an olefin or a polyolefin. Useful olefins include alpha-olefins, such as 1-decene, which are commercially available.

The polyolefins which can form the hydrocarbyl substituent can be prepared by polymerizing olefin monomers by well known polymerization methods and are also commercially available.

Some preferred polyolefins include polyisobutylenes having a number average molecular weight of 400 to 3000, in another instance of 400 to 2500, and in a further instance of 400 or 500 to 1500.

The hydrocarbyl-substituted phenol can be prepared by alkylating phenol with an olefin or polyolefin described above, such as, a polyisobutylene or polypropylene, using well-known alkylation methods.

In some embodiments the phenol may include a lower molecular weight alkyl substituent for example as is described in relation to the first aspect.

The aldehyde used to form the Mannich detergent can have 1 to 10 carbon atoms, and is generally formaldehyde or a reactive equivalent thereof such as formalin or paraformaldehyde.

The amine used to form the Mannich detergent can be a monoamine or a polyamine.

Examples of monoamines include but are not limited to ethylamine, dimethylamine, diethylamine, n-butylamine, dibutylamine, allylamine, isobutylamine, cocoamine, stearylamine, laurylamine, methyllaurylamine, oleylamine, N-methyl-octylamine, dodecylamine, diethanolamine, morpholine, and octadecylamine. Examples of suitable polyamines are defined in relation to the first aspect.

The preparation of quaternary ammonium salt additives in which the nitrogen-containing species includes component (iii) is described for example in US 2008/0113890.

The polyalkene-substituted amines having at least one tertiary amino group of the present invention may be derived from an olefin polymer and an amine, for example ammonia, monoamines, polyamines or mixtures thereof. They may be prepared by a variety of methods such as those described and referred to in US 2008/0113890.

Suitable preparation methods include, but are not limited to: reacting a halogenated olefin polymer with an amine; reacting a hydroformylated olefin with a polyamine and hydrogenating the reaction product; converting a polyalkene into the corresponding epoxide and converting the epoxide into the polyalkene substituted amine by reductive animation; hydrogenation of a β-aminonitrile; and hydroformylating an polybutene or polyisobutylene in the presence of a catalyst, CO and $H_2$ at elevated pressure and temperatures.

The olefin monomers from which the olefin polymers are derived include polymerizable olefin monomers characterised by the presence of one or more ethylenically unsaturated groups for example ethylene, propylene, 1-butene, isobutene, 1-octene, 1,3-butadiene and isoprene.

The olefin monomers are usually polymerizable terminal olefins. However, polymerizable internal olefin monomers can also be used to form the polyalkenes.

Examples of terminal and internal olefin monomers, which can be used to prepare the polyalkenes according to conventional, well-known polymerization techniques include: ethylene; propylene; butenes, including 1-butene, 2-butene and isobutylene; 1-pentene; 1-hexene; 1-heptene; 1-octene; 1-nonene; 1-decene; 2-pentene; propylene-tetramer; diisobutylene; isobutylene trimer; 1,2-butadiene; 1,3-butadiene; 1,2-pentadiene; 1,3-pentadiene; 1,4-pentadiene; isoprene; 1,5-hexadiene; 2-methyl-5-propyl-1-hexene; 3-pentene; 4-octene; and 3,3-dimethyl-1-pentene.

Suitably the polyalkene substituent of the polyalkene-substituted amine is derived from a polyisobutylene.

The amines that can be used to make the polyalkene-substituted amine include ammonia, monoamines, polyamines, or mixtures thereof, including mixtures of different monoamines, mixtures of different polyamines, and mixtures of monoamines and polyamines (which include diamines). The amines include aliphatic, aromatic, heterocyclic and carbocylic amines.

The monomers and polyamines suitably include at least one primary or secondary amine group.

Suitable monoamines are generally substituted with a hydrocarbyl group having 1 to about 50 carbon atoms, preferably 1 to 30 carbon atoms. Saturated aliphatic hydrocarbon radicals are particularly preferred.

Examples of suitable monoamines include methylamine, ethylamine, diethylamine, 2-ethylhexylamine, di-(2-ethylhexyl)amine, n-butylamine, di-n-butylamine, allylamine, isobutylamine, cocoamine, stearylamine, laurylamine, methyllaurylamine and oleylamine.

Aromatic monoamines include those monoamines wherein a carbon atom of the aromatic ring structure is attached directly to the amine nitrogen. Examples of aromatic monoamines include aniline, di(para-methylphenyl)amine, naphthylamine, and N-(n-butyl)aniline.

Examples of aliphatic substituted, cycloaliphatic-substituted, and heterocyclic-substituted aromatic monoamines include: para-dodecylaniline, cyclohexyl-substituted naphthylamine, and thienyl-substituted aniline respectively.

Hydroxy amines are also included in the class of useful monoamines. Examples of hydroxyl-substituted monoamines include ethanolamine, di-3-propanolamine, 4-hydroxybutylamine; diethanolamine, and N-methyl-2-hydroxypropylamine.

The amine of the polyalkene-substituted amine can be a polyamine. The polyamine may be aliphatic, cycloaliphatic, heterocyclic or aromatic.

Examples of suitable polyamines include alkylene polyamines, hydroxy containing polyamines, arylpolyamines, and heterocyclic polyamines.

Ethylene polyamines, are especially useful for reasons of cost and effectiveness. Suitable ethylene polyamines are described in relation to the first aspect.

Suitable hydroxy containing polyamines include hydroxyalkyl alkylene polyamines having one or more hydroxyalkyl substituents on the nitrogen atoms and can be prepared by reacting alkylenepolyamines with one or more alkylene oxides. Examples of suitable hydroxyalkyl-substituted polyamines include: N-(2-hydroxyethyl)ethylene diamine, N,N-bis(2-hydroxyethyl)ethylene diamine, 1-(2-hydroxyethyl)piperazine, monohydroxypropl-substituted diethylene triamine, dihydroxypropyl-substituted tetraethylene pentamine, propyl and N-(3-hydroxybutyl)tetramethylene diamine.

Suitable arylpolyamines are analogous to the aromatic monoamines mentioned above except for the presence within their structure of another amino nitrogen. Some examples of arylpolyamines include N,N'-di-n-butyl-para-phenylene diamine and bis-(para-aminophenyl)methane.

Suitable heterocyclic mono- and polyamines will be known to the person skilled in the art. Specific examples of such heterocyclic amines include N-aminopropylmorpholine, N-aminoethylpiperazine, and N,N'-diaminoethylpiperazine. Hydroxy heterocyclic polyamines may also be used for example N-(2-hydroxyethyl)cyclohexylamine, 3-hydroxycyclopentylamine, parahydroxy-aniline and N-hydroxyethlpiperazine.

Examples of polyalkene-substituted amines can include: poly(propylene)amine, poly(butene)amine, N,N-dimethylpolyisobutyleneamine; N-polybutenemorpholine, N-poly(butene)ethylenediamine, N-poly(propylene)trimethylenediamine, N-poly(butene)diethylenetriamine, N',N'-poly(butene)tetraethylenepentamine, and N,N-dimethyl-N'poly(propylene)-1,3 propylenediamine.

The number average molecular weight of the polyalkene-substituted amines can range from 500 to 5000, of from 500 to 3000, for example from 1000 to 1500.

Any of the above polyalkene-substituted amines which are secondary or primary amines, may be alkylated to tertiary amines using alkylating agents. Suitable alkylating agents and method using these will be known to the person skilled in the art.

To form the quaternary ammonium salt additives useful in the present invention, the nitrogen containing species having a tertiary amine group is reacted with a quaternizing agent.

The quaternizing agent is preferably selected from dialkyl sulphates, benzyl halides, hydrocarbyl substituted carbonates hydrocarbyl epoxides in combination with an acid, or mixtures thereof.

The composition of the present invention may contain a quaternizing agent suitable for converting the tertiary amino group to a quaternary nitrogen wherein the quaternizing agent is selected from the group consisting of dialkyl sulphates, alkyl halides, benzyl halides, hydrocarbyl substituted carbonates; and hydrocarbyl epoxides in combination with an acid or mixtures thereof.

The quaternizing agent can include halides, such as chloride, iodide or bromide; hydroxides; sulphonates; bisulphites, alkyl sulphates, such as dimethyl sulphate; sulphones; phosphates; C1-12 alkylphosphates; di C1-12 alkylphosphates; borates; C1-12 alkylborates; nitrites; nitrates; carbonates; bicarbonates; alkanoates; O,O-di C1-12 alkyldithiophosphates; or mixtures thereof.

In one embodiment the quaternizing agent may be derived from dialkyl sulphates such as dimethyl sulphate, N-oxides, sulphones such as propane and butane sulphone; alkyl, acyl or aralkyl halides such as methyl and ethyl chloride, bromide or iodide or benzyl chloride, and a hydrocarbyl (or alkyl) substituted carbonates. If the acyl halide is benzyl chloride, the aromatic ring is optionally further substituted with alkyl or alkenyl groups. The hydrocarbyl (or alkyl) groups of the hydrocarbyl substituted carbonates may contain 1 to 50, 1 to 20, 1 to 10 or 1 to 5 carbon atoms per group. In one embodiment the hydrocarbyl substituted carbonates contain two hydrocarbyl groups that may be the same or different. Examples of suitable hydrocarbyl substituted carbonates include dimethyl or diethyl carbonate.

In another embodiment the quaternizing agent can be a hydrocarbyl epoxide, as represented by the following formula, in combination with an acid:

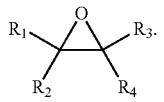

wherein RI, R2, R3 and R4 can be independently H or a C1-50 hydrocarbyl group.

Examples of hydrocarbyl epoxides can include styrene oxide, ethylene oxide, propylene oxide, butylene oxide, stilbene oxide and C2-50 epoxide.

The quaternary ammonium salt additives are preferably used in the fuel compositions of the present invention in an amount of less than 500 ppm, preferably less than 200 ppm, suitably less than 150 ppm, preferably less than 100 ppm, preferably less than 50 ppm, suitably less than 10 ppm.

The ratio of the engine cleaning additive to the quaternary ammonium salt additive, when present is preferably from 10:1 to 1:10, preferably from 5:1 to 1:5, more preferably from 3:1 to 1:3, for example from 2:1 to 1:2.

In some embodiments the fuel composition further comprises one or more nitrogen-containing detergents. Such nitrogen-containing detergents may be selected from any suitable nitrogen-containing ashless detergent or dispersant known in the art for use in lubricant or fuel oil. Suitably any nitrogen containing detergent present is not itself the product of a Mannich reaction between:

(a) an aldehyde;

(b) ammonia, hydrazine or an amine; and (c) an optionally substituted phenol, in which the or each substituent of the phenol component (c) has an average molecular weight of less than 400. Most preferably any nitrogen containing detergent present is not itself the product of any Mannich reaction between:

(a) an aldehyde;

(b) a polyamine; and (c) an optionally substituted phenol.

Preferred nitrogen-containing detergents are the reaction product of a carboxylic acid-derived acylating agent and an amine.

A number of acylated, nitrogen-containing compounds having a hydrocarbyl substituent of at least 8 carbon atoms and made by reacting a carboxylic acid acylating agent with an amino compound are known to those skilled in the art. In such compositions the acylating agent is linked to the amino compound through an imido, amido, amidine or acyloxy ammonium linkage. The hydrocarbyl substituent of at least 8 carbon atoms may be in either the carboxylic acid acylating agent derived portion of the molecule or in the amino compound derived portion of the molecule, or both. Preferably, however, it is in the acylating agent portion. The acylating agent can vary from formic acid and its acylating derivatives to acylating agents having high molecular weight aliphatic substituents of up to 5,000, 10,000 or 20,000 carbon atoms. The amino compounds can vary from ammonia itself to amines typically having aliphatic substituents of up to about 30 carbon atoms, and up to 11 nitrogen atoms.

A preferred class of acylated amino compounds suitable for use in the present invention are those formed by the reaction of an acylating agent having a hydrocarbyl substituent of at least 8 carbon atoms and a compound comprising at least one primary or secondary amine group. The acylating agent may be a mono- or polycarboxylic acid (or reactive equivalent thereof) for example a substituted succinic, phthalic or propionic acid and the amino compound may be a polyamine or a mixture of polyamines, for example a mixture of ethylene polyamines. Alternatively the amine may be a hydroxyalkyl-substituted polyamine. The hydrocarbyl substituent in such acylating agents is preferably as defined herein in relation to the nitrogen containing species (i) of the quaternary salts.

Amino compounds useful for reaction with these acylating agents include the following:

(1) polyalkylene polyamines of the general formula:

$$(R^3)_2N[U—N(R^3)]_nR^3$$

wherein each $R^3$ is independently selected from a hydrogen atom, a hydrocarbyl group or a hydroxy-substituted hydrocarbyl group containing up to about 30 carbon atoms, with proviso that at least one $R^3$ is a hydrogen atom, n is a whole number from 1 to 10 and U is a C1-18 alkylene group. Preferably each $R^3$ is independently selected from hydrogen, methyl, ethyl, propyl, isopropyl, butyl and isomers thereof. Most preferably each $R^3$ is ethyl or hydrogen. U is preferably a C1-4 alkylene group, most preferably ethylene.

(2) heterocyclic-substituted polyamines including hydroxyalkyl-substituted polyamines wherein the polyamines are as described above and the heterocyclic substituent is selected from nitrogen-containing aliphatic and aromatic heterocycles, for example piperazines, imidazolines, pyrimidines, morpholines, etc.

(3) aromatic polyamines of the general formula:

$$Ar(NR^3{}_2)_y$$

wherein Ar is an aromatic nucleus of 6 to 20 carbon atoms, each $R^3$ is as defined above and y is from 2 to 8.

Specific examples of polyalkylene polyamines (1) include ethylenediamine, diethylenetriamine, triethylenetetramine, tetraethylenepentamine, tri(tri-methylene)tetramine, pentaethylenehexamine, hexaethylene-heptamine, 1,2-propylenediamine, and other commercially available materials which comprise complex mixtures of polyamines. For example, higher ethylene polyamines optionally containing all or some of the above in addition to higher boiling fractions containing 8 or more nitrogen atoms etc. Specific examples of hydroxyalkyl-substituted polyamines include N-(2-hydroxyethyl) ethylene diamine, N,N'-bis(2-hydroxyethyl)ethylene diamine, N-(3-hydroxybutyl)tetramethylene diamine, etc. Specific examples of the heterocyclic-substituted polyamines (2) are N-2-aminoethyl piperazine, N-2 and N-3 amino propyl morpholine, N-3(dimethylamino)propyl piperazine, 2-heptyl-3-(2-aminopropyl)imidazoline, 1,4-bis(2-aminoethyl)piperazine, 1-(2-hydroxyethyl)piperazine, and 2-heptadecyl-1-(2-hydroxyethyl)-imidazoline, etc. Specific examples of the aromatic polyamines (3) are the various isomeric phenylene diamines, the various isomeric naphthalene diamines, etc.

Many patents have described useful acylated nitrogen compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763, 4,234,435 and U.S. Pat. No. 6,821,307.

One preferred acylated nitrogen-containing compound of this class is that made by reacting a poly(isobutene)-substituted succinic acid-derived acylating agent (e.g., anhydride, acid, ester, etc.) wherein the poly(isobutene) substituent has between about 12 to about 200 carbon atoms with a mixture of ethylene polyamines having 3 to about 9 amino nitrogen atoms per ethylene polyamine and about 1 to about 8 ethylene groups. These acylated nitrogen compounds are formed by the reaction of a molar ratio of acylating agent:amino compound of from 10:1 to 1:10, preferably from 5:1 to 1:5, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. This type of acylated amino compound and the preparation thereof is well known to those skilled in the art and are described in the above-referenced US patents.

A further preferred acylated nitrogen compound is one formed by the reaction of a succinic acid-derived acylating agent having a C1 to C20 alkyl substituent with an amine, ammonia or hydrazine. In such embodiments, the succinic acid acylating agent is preferably substituted with C8 to C16 substituent, most preferably a C12 substituent. This is preferably reacted with a polyalkylene polyamine as described above or especially hydrazine. The ratio of acylating agent to nitrogen-containing compound is preferably from 2:1 to 1:1.

Another type of acylated nitrogen compound belonging to this class is that made by reacting the afore-described alkylene amines with the afore-described substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 1:1. Typical of the monocarboxylic acid are formic acid, acetic acid, dodecanoic acid, butanoic acid, oleic acid, stearic acid, the commercial mixture of stearic acid isomers known as isostearic acid, tolyl acid, etc. Such materials are more fully described in U.S. Pat. Nos. 3,216,936 and 3,250,715.

A further type of acylated nitrogen compound suitable for use in the present invention is the product of the reaction of a fatty monocarboxylic acid of about 12-30 carbon atoms and the afore-described alkylene amines, typically, ethylene, propylene or trimethylene polyamines containing 2 to 8 amino groups and mixtures thereof. The fatty mono-carboxylic acids are generally mixtures of straight and branched chain fatty carboxylic acids containing 12-30 carbon atoms. Fatty dicarboxylic acids could also be used. A widely used type of acylated nitrogen compound is made by reacting the afore-described alkylene polyamines with a mixture of fatty acids having from 5 to about 30 mole percent straight chain acid and about 70 to about 95 percent mole branched chain fatty acids. Among the commercially available mixtures are those known widely in the trade as isostearic acid. These mixtures are produced as a by-product from the dimerization of unsaturated fatty acids as described in U.S. Pat. Nos. 2,812,342 and 3,260,671.

The branched chain fatty acids can also include those in which the branch may not be alkyl in nature, for example phenyl and cyclohexyl stearic acid and the chloro-stearic acids. Branched chain fatty carboxylic acid/alkylene polyamine products have been described extensively in the art. See for example, U.S. Pat. Nos. 3,110,673; 3,251,853; 3,326,801; 3,337,459; 3,405,064; 3,429,674; 3,468,639; 3,857,791. These patents are referenced for their disclosure of fatty acid/polyamine condensates for their use in lubricating oil formulations.

Preferred nitrogen-containing detergents for use herein include: the compound formed by reacting a polyisobutylene succinic anhydride (PIBSA) having a PIB molecular weight of 900 to 1100, for example approximately 1000, with aminoethyl ethanolamine or triethylene tetramine; and the compound formed by reacting a PIBSA having a PIB molecular weight of 650 to 850, for example about 750 with tetraethylene pentamine. In each case the ratio of PIBSA to amine is from 1.5:1 to 0.9:1, preferably from 1.2:1 to 1:1.

The nitrogen-containing detergent when present is suitably present in the fuel composition of the second aspect in an amount of less than 1000 ppm, preferably less than 500 ppm, preferably less than 300 ppm, more preferably less than 200 ppm, preferably up to 100 ppm and most preferably less than 70 ppm. The nitrogen-containing detergent maybe present in an amount of at least 1 ppm, suitably at least 10 ppm, for example at least 20 ppm, or at least 30 ppm.

In embodiments in which more than one nitrogen containing detergent is present, the above amounts refer to the total amount of all such detergents present in the composition.

All values of ppm given herein refer to parts per million by weight of the total composition.

Preferably the weight ratio of the engine cleaning additive to the nitrogen-containing detergent (when present) is at least 0.5:1, preferably at least 1:1, more preferably at least 2:1. The ratio of engine cleaning additive to nitrogen-containing detergent may be at least 2.5:1, preferably at least 3:1, suitably at least 4:1, preferably at least 5:1, for example at least 7:1 or at least 9:1. It may be at least 10:1, for example at least 11:1, at least 12:1 or at least 15:1. In some embodiments the ratio may be at least 17:1 or at least 20:1.

The weight ratio of the engine cleaning additive to the nitrogen-containing detergent may be up to 100:1, suitably up to 50:1, for example up to 30:1.

In embodiments in which more than one engine cleaning additive and/or more than one nitrogen-containing detergent is present, the above ratios refer to the total amount of each type of additive present in the diesel fuel composition.

In some embodiments the engine cleaning additive is present in the diesel fuel composition in an amount of from 120 to 480 ppm and the ratio of engine cleaning additive to nitrogen-containing detergent is from 2.5:1 to 7.5:1.

In some embodiments the engine cleaning additive is present in the diesel fuel composition in an amount of from 150 to 450 ppm and the ratio of engine cleaning additive to nitrogen containing detergent is from 3:1 to 15:1.

In some embodiments the engine cleaning additive is present in the diesel fuel composition in an amount of from 150 to 750 ppm and the ratio of engine cleaning additive to nitrogen containing detergent is from 2.5:1 to 8:1.

In some embodiments, the engine cleaning additive is present in the diesel fuel composition in an amount of from 150 to 1000 ppm and the ratio of engine cleaning additive to nitrogen containing detergent is from 11:1 to 25:1.

In some preferred embodiments the diesel fuel composition of the present invention further comprises a metal deactivating compound. Any metal deactivating compound known to those skilled in the art may be used and include, for example, the substituted triazole compounds of figure IX wherein R and R' are independently selected from an optionally substituted alkyl group or hydrogen.

IX

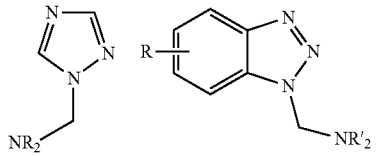

Preferred metal deactivating compounds are those of formula V:

X

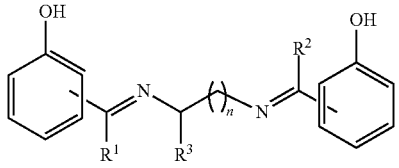

wherein $R^1$, $R^2$ and $R^3$ are independently selected from an optionally-substituted alkyl group or hydrogen, preferably an alkyl group from 1 to 4 carbon atoms or hydrogen. $R^1$ is preferably hydrogen, $R^2$ is preferably hydrogen and $R^3$ is preferably methyl. n is an integer from 0 to 5, most preferably 1.

A particularly preferred metal deactivator is N,N'-disalicyclidene-1,2-diaminopropane, and has the formula shown in figure XI.

XI

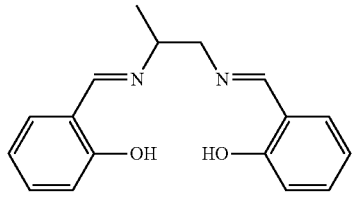

Another preferred metal deactivating compound is shown in figure XII:

XII

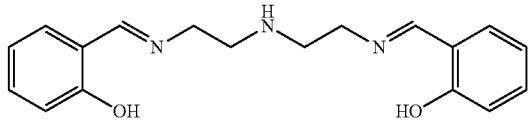

The metal deactivating compound is preferably present in an amount of less than 100 ppm, and more preferably less than 50 ppm, preferably less than 30 ppm, more preferably less than 20, preferably less than 15, preferably less than 10 and more preferably less than 5 ppm. The metal deactivator is preferably present as an amount of from 0.0001 to 50 ppm, preferably 0.001 to 20, more preferably 0.01 to 10 ppm and most preferably 0.1 to 5 ppm.

The weight ratio of the performance enhancing additive to the metal deactivator is preferably from 100:1 to 1:100, more preferably from 50:1 to 1:50, preferably from 25:1 to 1; 25, more preferably from 10:1 to 1:10, preferably from 5:1 to 1:5, preferably from 3:1 to 1:3, more preferably from 2:1 to 1:2 and most preferably from 1.5:1 to 1:1.5.

The diesel fuel composition may include one or more further additives such as those which are commonly found in diesel fuels. These include, for example, antioxidants, dispersants, detergents, wax anti-settling agents, cold flow improvers, cetane improvers, dehazers, stabilisers, demulsifiers, antifoams, corrosion inhibitors, lubricity improvers, dyes, markers, combustion improvers, odour masks, drag reducers and conductivity improvers.

In particular, the diesel fuel composition may further comprise one or more additives known to improve the performance of diesel engines especially diesel engines having high pressure fuel systems. Such additives are known to those skilled in the art and include, for example, the compounds described in EP 1900795, EP 1887074 and EP 1884556.

Suitably the diesel fuel composition may include an additive comprising a salt formed by the reaction of a carboxylic acid with a di-n-butylamine or tri-n-butylamine. Suitably the carboxylic acid is a fatty acid is of the formula $[R'(COOH)_x]_y$, where each R' is a independently a hydrocarbon group of between 2 and 45 carbon atoms, and x is an integer between 1 and 4. Further details of such additives are descried in EP 1900795.

The treat rate of such additives would typically be less than less than 400 ppm or less than 200 ppm and possibly less than 20 ppm, for example down to 5 ppm or 2 ppm, when used in combination with the engine cleaning additives of the present invention.

Suitably the diesel fuel composition may include an additive comprising the reaction product between a hydrocarbyl-substituted succinic acid or anhydride and hydrazine. Compounds of this type are described in EP 1887074. Preferred hydrocarbyl substituted succinic acids and anhydrides are as previously described herein.

The treat rate of such additives would typically be less than 500 ppm or less than 100 ppm and possibly less than 20 ppm or less than 10 ppm, for example down to 5 ppm or 2 ppm, when used in combination with the engine cleaning additives of this invention.

Suitably the diesel fuel composition may include an additive comprising at least one compound of formula (XI) and/or formula (XII):

(XI)

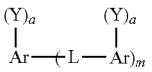

wherein each Ar independently represents an aromatic moiety having 0 to 3 substituents selected from the group consisting of alkyl, alkoxy, alkoxyalkyl, aryloxy, aryloxyalkyl, hydroxy, hydroxyalkyl, halo and combinations thereof;

each L is independently a linking moiety comprising a carbon-carbon single bond or a linking group;

each Y is independently —$OR^{1''}$ or a moiety of the formula $H(O(CR^1{}_2)_n)_yX$—, wherein X is selected from the group consisting of $(CR^1{}_2)_z$, O and S: $R^1$ and $R^{1'}$ are each independently selected from H, $C_1$ to $C_6$ alkyl and aryl; $R^{1''}$ is selected from $C_1$ to $C_{100}$ alkyl and aryl; z is 1 to 10; n is 0 to 10 when X is $(CR^1{}_2)_z$, and 2 to 10 when X is O or S; and y is 1 to 30; each a is independently 0 to 3, with the proviso that at least one Ar moiety bears at least one group Y; and m is 1 to 100;

(XII)

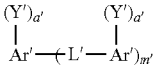

wherein each Ar' independently represents an aromatic moiety having 0 to 3 substituents selected from the group consisting of alkyl, alkoxy, alkoxyalkyl, hydroxy, hydroxyalkyl, acyloxy, acyloxyalkyl, acyloxyalkoxy, aryloxy, aryloxyalkyl, aryloxyalkoxy, halo and combinations thereof;

each L' is independently a linking moiety comprising a carbon-carbon single bond or linking group;

each Y' is independently a moiety of the formula ZO— or $Z(O(CR^2{}_2)_{n'})_{y'}X'$—, wherein X' is selected from the group consisting of $(CR^{2'}{}_2)_{z'}$, O and S; $R^2$ and $R^{2'}$ are each independently selected from H, $C_1$ to $C_6$ alkyl and aryl z' is 1 to 10; n' is 0 to 10 when X' is $(CR^{2'}{}_2)_{z'}$, and 2 to 10 when X' is O or S; y is 1 to 30; Z is H, an acyl group, a polyacyl group, a lactone ester group, an acid ester group, an alkyl group or an aryl group;

each a' is independently 0 to 3, with the proviso that at least one Ar' moiety bears at least one group Y' in which Z is not H; and m' is 1 to 100.

These compounds are further described in EP 1884556.

The treat rate of such additives would typically be less than 300 ppm and possibly less than 50 ppm, for example down to 20 ppm or 10 ppm, when used in combination with the engine cleaning additives of the present invention.

The diesel fuel composition of the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition may comprise non-renewable Fischer-Tropsch fuels such as those described as GTL (gas-to-liquid) fuels, CTL (coal-to-liquid) fuels and OTL (oil sands-to-liquid).

The diesel fuel composition may comprise a renewable fuel such as a biofuel composition or biodiesel composition.

The diesel fuel composition may comprise first generation biodiesel. First generation biodiesel contains esters of, for example, vegetable oils, animal fats and used cooking fats. This form of biodiesel may be obtained by transesterification of oils, for example rapeseed oil, soybean oil, safflower oil, palm 25 oil, corn oil, peanut oil, cotton seed oil, tallow, coconut oil, physic nut oil (Jatropha), sunflower seed oil, used cooking oils, hydrogenated vegetable oils or any mixture thereof, with an alcohol, usually a monoalcohol, in the presence of a catalyst.

The diesel fuel composition may comprise second generation biodiesel. Second generation biodiesel is derived from renewable resources such as vegetable oils and animal fats and processed, often in the refinery, often using hydroprocessing such as the H-Bio process developed by Petrobras. Second generation biodiesel may be similar in properties and quality to petroleum based fuel oil streams, for example renewable diesel produced from vegetable oils, animal fats etc. and marketed by ConocoPhillips as Renewable Diesel and by Neste as NExBTL.

The diesel fuel composition may comprise third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit a greater proportion of the plant (biomass) and thereby widens the feedstock base.

The diesel fuel composition may contain blends of any or all of the above diesel fuel compositions.

In some embodiments the diesel fuel composition may be a blended diesel fuel comprising bio-diesel. In such blends the bio-diesel may be present in an amount of, for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the diesel fuel composition may comprise a secondary fuel, for example ethanol. Preferably however the diesel fuel composition does not contain ethanol.

Preferably, the diesel fuel has a sulphur content of at most 0.1% by weight, preferably of at most 0.05% by weight, more preferably of at most 0.035% by weight, especially of at most 0.015%. Fuels with even lower levels of sulphur are also suitable such as fuels with less than 50 ppm sulphur by weight, preferably less than 20 ppm, for example 10 ppm or less.

As detailed above the problem of engine fouling is particularly apparent in fuel compositions comprising a metal-containing species and thus the method of the present invention may be particularly applicable when such fuels are used.

Commonly when present, metal-containing species will be present as a contaminant, for example through the corrosion of metal and metal oxide surfaces by acidic species present in the fuel or from lubricating oil. In use, fuels such as diesel fuels routinely come into contact with metal surfaces for example, in vehicle fuelling systems, fuel tanks, fuel transportation means etc. Typically, metal-containing contamination will comprise transition metals such as zinc, iron and copper and others such as lead.

In addition to metal-containing contamination which may be present in diesel fuels there are circumstances where metal-containing species may deliberately be added to the fuel. For example, as is known in the art, metal-containing fuel-borne catalyst species may be added to aid with the regeneration of particulate traps. Such catalysts are often based on metals such as iron, cerium, Group I and Group II metals e.g., calcium and strontium, either as mixtures or alone. Also used are platinum and manganese. The presence of such catalysts may also give rise to injector deposits when the fuels are used in diesel engines having high pressure fuel systems.

Metal-containing contamination, depending on its source, may be in the form of insoluble particulates or soluble compounds or complexes. Metal-containing fuel-borne catalysts are often soluble compounds or complexes or colloidal species.

In some embodiments, the metal-containing species comprises a fuel-borne catalyst.

In some embodiments, the metal-containing species comprises zinc.

The amount of metal-containing species in the diesel fuel compositions of the present invention, expressed in terms of the total weight of metal in the species, may be between 0.01 and 50 ppm by weight, for example between 0.1 and 10 ppm by weight, based on the weight of the diesel fuel.

The present invention provides a method of removing deposits from a diesel engine. In the method deposits are removed such that the level of deposits in the engine decrease following combustion in the engine of the fuel composition of the present invention.

In the method of the present invention, some or all of the deposits on the engine may be removed. Deposits may be removed from all parts of the engine where present or they be removed from a specific part of the engine, for example the injectors.

The removal of the deposits may be gradual in which case the level of deposits falls slowly over time. Alternatively the removal of the deposits may be rapid, in which case the level of deposits falls quickly over time.

Although it may be possible to measure levels of deposit by physically removing injectors from an engine and weighing them, such direct measurements are not preferred.

One preferred way of measuring the clean-up of deposits is by measuring an increase in power output of the engine which is observed as the deposits are removed.

The increase in power output is a significant advantage provided by the present invention. In some cases where rapid removal of deposits is achieved, the resultant increase in power will be readily observable by a user which will lead to increased consumer satisfaction.

Preferably the method of the present invention provides an increase in power of an engine of at least 1% after running the engine for 32 hours, preferably an increase in power of at least 2%, for example at least 3%, suitably at least 4%, for example at least 5%. In this definition the percentage increase in power is measured with respect to the power output of the engine immediately prior to running the engine according to the method of the present invention.

Suitably the method of the present invention provides an increase in power of an engine of at least 1% after running the engine for 24 hours, preferably an increase in power of at least 2%, for example at least 3%, suitably at least 4%, for example at least 5%.

Suitably the method of the present invention provides an increase in power of an engine of at least 1% after running the engine for 12 hours, preferably an increase in power of at least 2%, for example at least 3%, suitably at least 4%, for example at least 5%.

Suitably the method of the present invention provides an increase in power of an engine of at least 1% after running the engine for 5 hours, preferably an increase in power of at least 2%, for example at least 3%, suitably at least 4%, for example at least 5%.

In some embodiments the method of the present invention may provide an increase in power of at least 1% after running the engine for 1 hour, preferably an increase in power of at least 2%, for example at least 3%, suitably at least 4%, for example at least 5%.

The present invention removes deposits from a fouled engine, in particular a fouled injector. It is an aim of preferred embodiments to remove as many of the deposits as possible and thus restore the power output of the engine to the level obtained when clean injectors are fitted. Clean injectors can include new injectors or injectors which have been removed and physically cleaned, for example in an ultrasound bath.

Suitably after running the engine according to the method of the present invention for at least 32 hours, the engine has a power output of at least 90% of the power output obtained when using clean injectors, suitably at least 93%, for example at least 95%, preferably at least 97%, for example at least 98%.

Suitably after running the engine according to the method of the present invention for at least 24 hours, the engine has a power output of at least 90% the power output obtained when using clean injectors, suitably at least 93%, for example at least 95%, preferably at least 97%, for example at least 98%.

Suitably after running the engine according to the method of the present invention for 12 hours, the engine has a power output of at least 90% of the power output obtained when using clean injectors, suitably at least 93%, for example at least 95%, preferably at least 97%, for example at least 98%.

Suitably after running the engine according to the method of the present invention for at least 5 hours, the engine has a power output of at least 90% of the power output obtained when using clean injectors, suitably at least 93%, for example at least 95%, preferably at least 97%, for example at least 98%.

In some embodiments after running the engine according to the method of the present invention for 1 hour, the engine has a power output of at least 90% of the power output obtained when using clean injectors, suitably at least 93%, for example at least 95%, preferably at least 97%, for example at least 98%.

An industry standard method for measuring injector fouling in modern diesel engines with high pressure fuel systems uses a DW-10 engine according to the standard test method CEC-F-98-08 (Direct Injection, Common Rail Diesel Engine Nozzle Coking Test). This method may be used to assess whether fuel compositions fall within the scope of the present invention. However the present invention is not limited to engines of this type.

Deposits may be removed from any part of the engine. In particular the present invention provides a method of removing deposits from the injectors of a diesel engine.

The method of the present invention may be used to remove deposits from any type of diesel engine. However it is particularly effective at removing deposits from diesel engines having a high pressure fuel system.

The diesel fuel compositions of the present invention may remove deposits when used with traditional diesel engines. Preferably the present invention can be used to remove deposits in modern diesel engines having high pressure fuel systems and when using the compositions in traditional diesel engines. This is important because it allows a single fuel to be provided that can be used in new engines and older vehicles.

Modern diesel engines having a high pressure fuel system may be characterised in a number of ways. Such engines are typically equipped with fuel injectors having a plurality of apertures, each aperture having an inlet and an outlet.

Such modern diesel engines may be characterised by apertures which are tapered such that the inlet diameter of the spray-holes is greater than the outlet diameter.

Such modern engines may be characterised by apertures having an outlet diameter of less than 500 μm, preferably less than 200 μm, more preferably less than 150 μm, preferably less than 100 μm, most preferably less than 80 μm or less.

Such modern diesel engines may be characterised by apertures where an inner edge of the inlet is rounded.

Such modern diesel engines may be characterised by the injector having more than one aperture, suitably more than 2 apertures, preferably more than 4 apertures, for example 6 or more apertures.

Such modern diesel engines may be characterised by an operating tip temperature in excess of 250° C.

Such modern diesel engines may be characterised by a fuel pressure of more than 1350 bar, preferably more than 1500 bar, more preferably more than 2000 bar.

The present invention preferably improves the performance of an engine having one or more of the above-described characteristics.

The present invention is especially useful for removing deposits from injectors of engines operating at high pressures and temperatures in which fuel may be recirculated and which comprise a plurality of fine apertures through which the fuel is delivered to the engine. The present invention finds utility in engines for heavy duty vehicles and passenger vehicles. Passenger vehicles incorporating a high speed direct injection (or HSDI) engine may for example benefit from the present invention.

Within the injector body, clearances of only 1-2 μm exist between moving parts and there have been reports of engine problems in the field caused by injectors sticking and particularly injectors sticking open. Control of deposits in this area can be very important. The method of the present invention may remove deposits including gums and lacquers within the injector body.

The method of the present invention may also remove deposits from the vehicle fuel filter.

The level of deposits in a vehicle fuel filter may be measured quantitatively or qualitatively. In some cases this may only be determined by inspection of the filter once the filter has been removed. In other cases, the level of deposits may be estimated during use.

Many vehicles are fitted with a fuel filter which may be visually inspected during use to determine the level of solids build up and the need for filter replacement. For example, one such system uses a filter canister within a transparent housing allowing the filter, the fuel level within the filter and the degree of filter blocking to be observed.

The present invention may result in removal of deposits from the fuel filter allows the filter to be changed much less frequently and can ensure that fuel filters do not fail between service intervals. Thus the present invention may lead to reduced maintenance costs.

In especially preferred embodiments the method of the present invention involves a method of removing deposits from the injectors of a diesel engine, especially a diesel engine having a high pressure fuel system.

By reducing the level of deposits in the injectors the present invention may reduce the need for injector maintenance, thus reducing maintenance costs.

Direct measurement of the deposit levels is not usually undertaken, but is typically inferred from the power loss or fuel flow rates through the injector. Power loss could be measured in a controlled engine test, for example as described in relation to example 3.

In Europe the Co-ordinating European Council for the development of performance tests for transportation fuels, lubricants and other fluids (the industry body known as CEC), has developed a new test, named CEC F-98-08, to assess whether diesel fuel is suitable for use in engines meeting new European Union emissions regulations known as the "Euro 5" regulations. The test is based on a Peugeot DW10 engine using Euro 5 injectors, and will hereinafter be referred to as the DW10 test. It will be further described in the context of the examples.

Preferably the method of the present invention leads to reduced deposits as measured by the DW10 test.

The DW10 test is used to measure the power loss in modern diesel engines having a high pressure fuel system.

For older engines an improvement in performance due to removal of deposits may be measured using the XUD9 test.

Suitably the use of a fuel composition of the present invention may provide a "clean up" performance in modern diesel engines, that is deposits on the injectors of an already fouled engine may be removed. Preferably this performance is such that the power of a fouled engine may be returned to within 1% of the level achieved when using clean injectors within 8 hours as measured in the DW10 test.

Preferably rapid "clean-up" may be achieved in which the power is returned to within 1% of the level observed using clean injectors within 4 hours, preferably within 2 hours.

Clean injectors can include new injectors or injectors which have been removed and physically cleaned, for example in an ultrasound bath.

Such performance is illustrated in the examples

Suitably the present invention may provide a "clean up" performance in traditional diesel engines, that is deposits on the injectors of an already fouled engine may be removed. Preferably this performance is such that the flow loss of a fouled engine may be increased by 10% or more within 10 hours as measured in the XUD-9 test.

According to a third aspect of the present invention there is provided the use of an engine cleaning additive to remove deposits from a diesel engine, wherein the engine cleaning additive is the product of a Mannich reaction between:

(a) an aldehyde;

(b) ammonia, hydrazine or an amine; and (c) an optionally substituted phenol;

wherein the or each substituent of the phenol component (c) has an average molecular weight of less than 400.

The present invention further provides the use of a combination of a quaternary ammonium salt additive and an engine cleaning additive to remove deposits from a diesel engine, wherein the engine cleaning additive is the product of a Mannich reaction between:

(a) an aldehyde;

(b) ammonia, hydrazine or an amine; and (c) an optionally substituted phenol;

wherein the or each substituent of the phenol component (c) has an average molecular weight of less than 400.

The present invention further provides the use of a combination of a nitrogen containing detergent and an engine cleaning additive to remove deposits from a diesel engine, wherein the engine cleaning additive is the product of a Mannich reaction between:

(a) an aldehyde;

(b) ammonia, hydrazine or an amine; and (c) an optionally substituted phenol;

wherein the or each substituent of the phenol component (c) has an average molecular weight of less than 400.

The present invention further provides the use of a combination of a quaternary ammonium salt additive, a nitrogen containing detergent and an engine cleaning additive to remove deposits from a diesel engine, wherein the engine cleaning additive is the product of a Mannich reaction between:

(a) an aldehyde;

(b) ammonia, hydrazine or an amine; and (c) an optionally substituted phenol;

wherein the or each substituent of the phenol component (c) has an average molecular weight of less than 400.

Any feature of any aspect of the invention may be combined with any other feature, where appropriate.

The invention will now be further defined with reference to the following non-limiting examples. In these examples the values given in parts per million (ppm) for treat rates denote active agent amount, not the amount of a formulation as added, and containing an active agent.

Example 1

Preparation of Additive A

A 1 liter reactor was charged with dodecylphenol (502.7 g, 1.92 equivalents), aminoethyl ethanolamine (99.8 g, 0.959 equivalents) and Caromax 20 (219.6 g). The mixture was heated to 95° C. and formaldehyde solution, 36.6 wt % (166.6 g, 2.03 equivalents) charged over 1 hour. The temperature was increased to 125° C. for 4 hours and 130 g water removed.

In this example the molar ratio of aldehyde(a):amine(b):phenol(c) was approximately 2:1:2.

Example 2

Preparation of Additive B

A 1 liter reactor was charged with dodecylphenol (524.6 g, 2.00 equivalents), ethylenediamine (60.6 g, 1.01 equivalents) and Caromax 20 (250.1 g). The mixture was heated to 95° C. and formaldehyde solution, 37 wt % (167.1 g, 2.06 equivalents) charged over 1 hour. The temperature was increased to 125° C. for 3 hours and 125.6 g water removed.

In this example the molar ratio of aldehyde(a):amine(b):phenol(c) was approximately 2:1:2.

Example 3

Diesel fuel compositions were prepared comprising the additives listed in Table 1, added to aliquots all drawn from a common batch of RF06 base fuel, and containing 1 ppm zinc (as zinc neodecanoate).

Table 2 below shows the specification for RF06 base fuel.

TABLE 1

| Fuel composition | Additive A (ppm active) | Additive B (ppm active) | Additive C (ppm active) |
|---|---|---|---|
| 1 | 2100 | | 120 |
| 2 | | 375 | |
| 3 | | 2100 | 120 |
| 4 | | 2100 | 120 |

Additive C is a 60% active ingredient solution (in aromatic solvent) of a polyisobutenyl succinimide obtained from the condensation reaction of a polyisobutenyl succinic anhydride derived from polyisobutene of Mn approximately 750 with a polyethylene polyamine mixture of average composition approximating to tetraethylene pentamine.

TABLE 2

| Property | Units | Limits Min | Limits Max | Method |
|---|---|---|---|---|
| Cetane Number | | 52.0 | 54.0 | EN ISO 5165 |
| Density at 15° C. | kg/m$^3$ | 833 | 837 | EN ISO 3675 |
| Distillation | | | | |
| 50% v/v Point | ° C. | 245 | — | |
| 95% v/v Point | ° C. | 345 | 350 | |
| FBP | ° C. | — | 370 | |
| Flash Point | ° C. | 55 | — | EN 22719 |
| Cold Filter Plugging Point | ° C. | — | −5 | EN 116 |
| Viscosity at 40° C. | mm$^2$/sec | 2.3 | 3.3 | EN ISO 3104 |
| Polycyclic Aromatic Hydrocarbons | % m/m | 3.0 | 6.0 | IP 391 |
| Sulphur Content | mg/kg | — | 10 | ASTM D 5453 |
| Copper Corrosion | | — | 1 | EN ISO 2160 |
| Conradson Carbon Residue on 10% Dist. Residue | % m/m | — | 0.2 | EN ISO 10370 |
| Ash Content | % m/m | — | 0.01 | EN ISO 6245 |
| Water Content | % m/m | — | 0.02 | EN ISO 12937 |
| Neutralisation (Strong Acid) Number | mg KOH/g | — | 0.02 | ASTM D 974 |
| Oxidation Stability | mg/mL | — | 0.025 | EN ISO 12205 |
| HFRR (WSD1, 4) | µm | — | 400 | CEC F-06-A-96 |
| Fatty Acid Methyl Ester | | prohibited | | |

Fuel compositions 1 to 4 listed in table 1 were tested according to the CECF-98-08 DW 10 method.

The engine of the injector fouling test is the PSA DW10BTED4. In summary, the engine characteristics are:

Design: Four cylinders in line, overhead camshaft, turbocharged with EGR

Capacity: 1998 cm$^3$

Combustion chamber: Four valves, bowl in piston, wall guided direct injection

Power: 100 kW at 4000 rpm

Torque: 320 Nm at 2000 rpm

Injection system: Common rail with piezo electronically controlled 6-hole injectors.

Max. pressure: 1600 bar ($1.6\times10^8$ Pa). Proprietary design by SIEMENS VDO

Emissions control: Conforms with Euro IV limit values when combined with exhaust gas post-treatment system (DPF)

This engine was chosen as a design representative of the modern European high-speed direct injection diesel engine capable of conforming to present and future European emissions requirements. The common rail injection system uses a highly efficient nozzle design with rounded inlet edges and conical spray holes for optimal hydraulic flow. This type of nozzle, when combined with high fuel pressure has allowed advances to be achieved in combustion efficiency, reduced noise and reduced fuel consumption, but are sensitive to influences that can disturb the fuel flow, such as deposit formation in the spray holes. The presence of these deposits causes a significant loss of engine power and increased raw emissions.

The test is run with a future injector design representative of anticipated Euro V injector technology.

It is considered necessary to establish a reliable baseline of injector condition before beginning fouling tests, so a sixteen hour running-in schedule for the test injectors is specified, using non-fouling reference fuel.

Full details of the CEC F-98-08 test method can be obtained from the CEC. The coking cycle is summarised below.

1. A warm up cycle (12 minutes) according to the following regime:

| Step | Duration (minutes) | Engine Speed (rpm) | Torque (Nm) |
|---|---|---|---|
| 1 | 2 | idle | <5 |
| 2 | 3 | 2000 | 50 |
| 3 | 4 | 3500 | 75 |
| 4 | 3 | 4000 | 100 |

2. 8 hrs of engine operation consisting of 8 repeats of the following cycle

| Step | Duration (minutes) | Engine Speed (rpm) | Load (%) | Torque (Nm) | Boost Air After IC (° C.) |
|---|---|---|---|---|---|
| 1 | 2 | 1750 | (20) | 62 | 45 |
| 2 | 7 | 3000 | (60) | 173 | 50 |
| 3 | 2 | 1750 | (20) | 62 | 45 |
| 4 | 7 | 3500 | (80) | 212 | 50 |
| 5 | 2 | 1750 | (20) | 62 | 45 |
| 6 | 10 | 4000 | 100 | * | 50 |
| 7 | 2 | 1250 | (10) | 20 | 43 |
| 8 | 7 | 3000 | 100 | * | 50 |
| 9 | 2 | 1250 | (10) | 20 | 43 |
| 10 | 10 | 2000 | 100 | * | 50 |
| 11 | 2 | 1250 | (10) | 20 | 43 |
| 12 | 7 | 4000 | 100 | * | 50 |

* for expected range see CEC method CEC-F-98-08

3. Cool down to idle in 60 seconds and idle for 10 seconds
4. 4 hrs soak period

The standard CEC F-98-08 test method consists of 32 hours engine operation corresponding to 4 repeats of steps 1-3 above, and 3 repeats of step 4. ie 56 hours total test time excluding warm ups and cool downs.

In the case of fuel compositions 1 to 3 listed in table 1, a first 32 hour cycle was run using new injectors and RF-06 base fuel having added thereto 1 ppm Zn (as neodecanoate). This resulted in a level of power loss due to fouling of the injectors.

A second 32 hour cycle was then run as a 'clean up' phase. The dirty injectors from the first phase were kept in the engine and the fuel changed to RF-06 base fuel having added thereto 1 ppm Zn (as neodecanoate) and the test additives specified.

Figure 2:
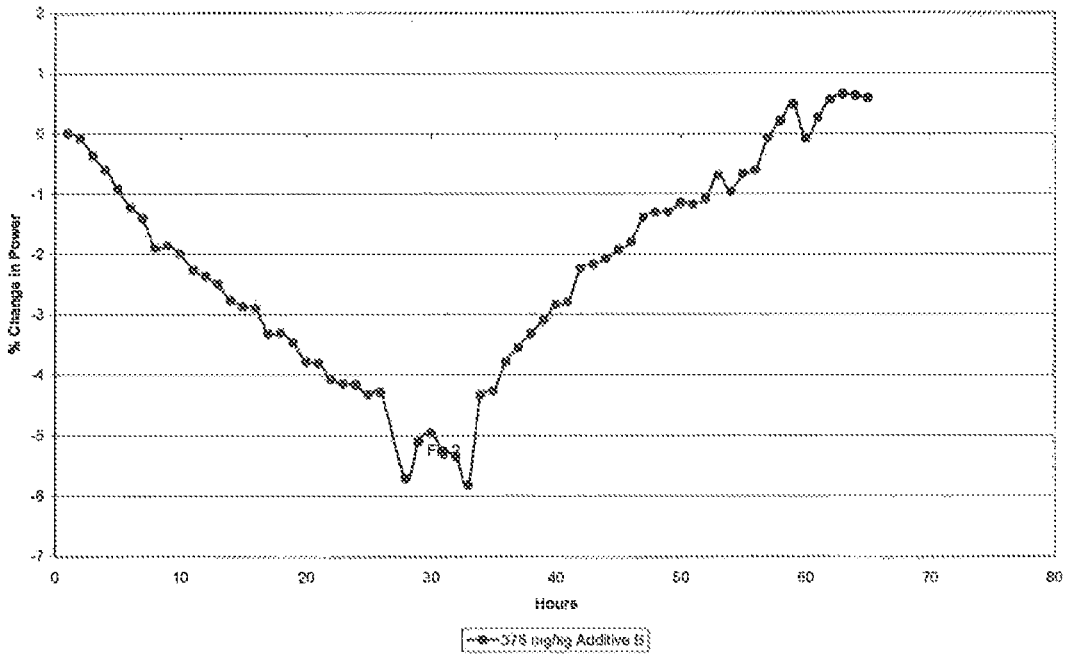
FIG. 2 is a graph showing the power output of an engine using composition 2 in an injector "clean up" test.
Figure 3:
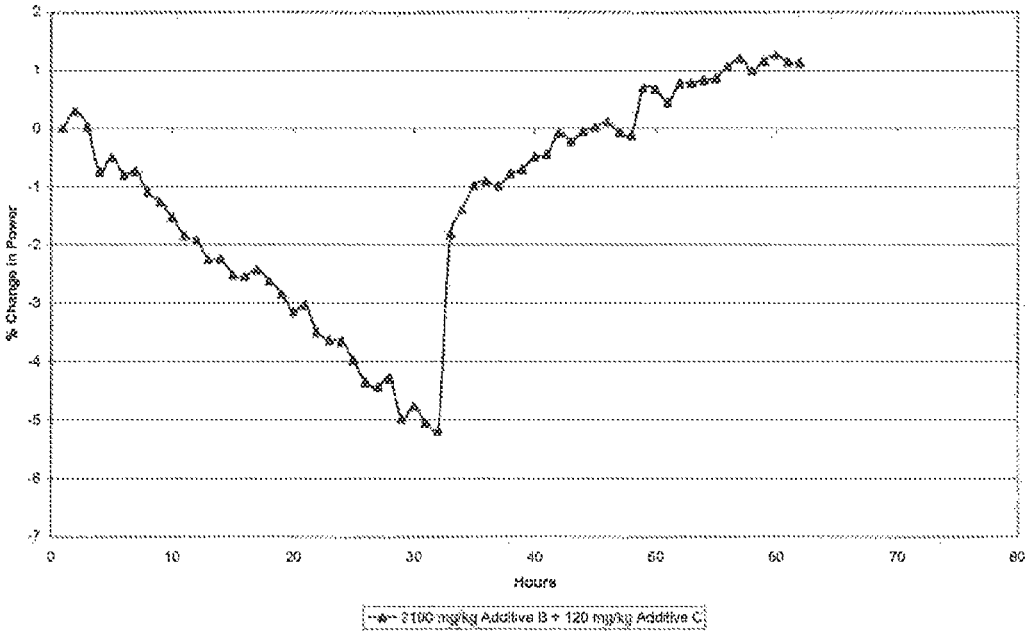
FIG. 3 is a graph showing the power output of an engine using composition 3 in an injector "clean up" test.

FIG. 1 shows the power output of the engine when running fuel composition 1 over the test period;

FIG. 2 shows the power output of the engine when running fuel composition 2 over the test period;

FIG. 3 shows the power output of the engine when running fuel composition 3 over the test period.

Compositions 1 to 3 were all tested on the same engine. In the case of composition 4, a new engine was used. In this case a longer period was needed to cause the initial fouling of the engine. Thus the first cycle was extended to 48 hours.

Figure 4:
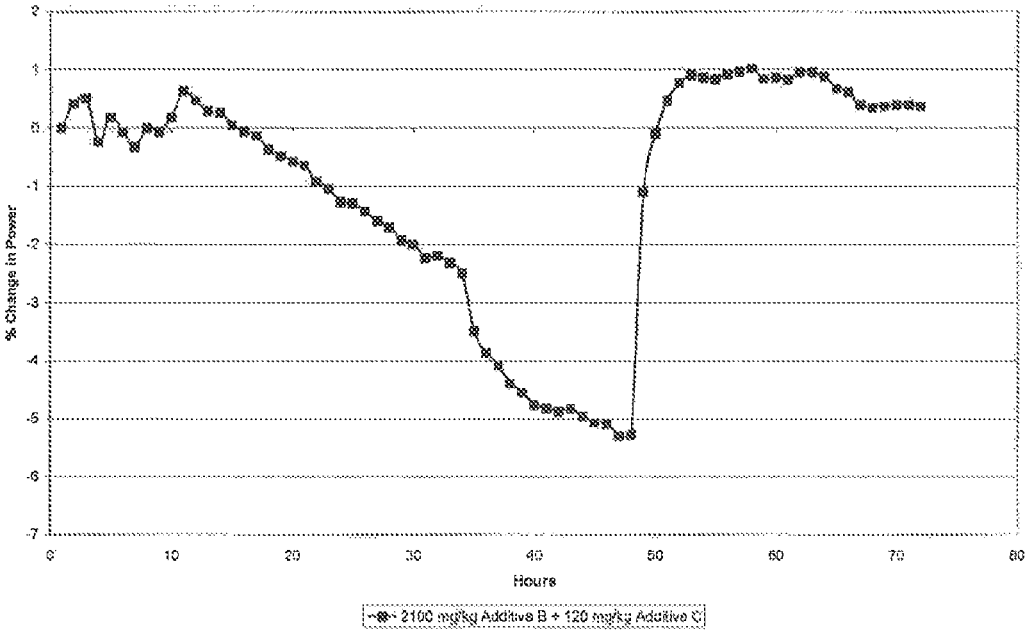
FIG. 4 is a graph showing the power output of an engine using composition 4 in an injector "clean up" test.

FIG. 4 shows the power output of the engine when running fuel composition 4 over the test period.

Example 4

Additive D was prepared as follows:

A polyisobutyl-substituted succinic anhydride (PIBSA) having a PIB molecular weight of 1000 (4021.1 g, 3.27 eq) and aromatic solvent Caromax 20 (2907 g) were charged to a 10 liter reactor and heated under nitrogen to 60° C. Triethylenetetramine (398.7 g, 2.7 eq) was charged and the reactor contents heated to 155° C. Water of reaction was removed.

The diesel fuel compositions shown in table 3 were prepared by adding the specified amounts of additives to RF06 base fuel comprising 1 ppm zinc.

TABLE 3

| Fuel Composition | Additive B (ppm active) | Additive D (ppm active) |
|---|---|---|
| 5 | 634 | 195 |
| 6 | 567 | 257 |

Figure 5:
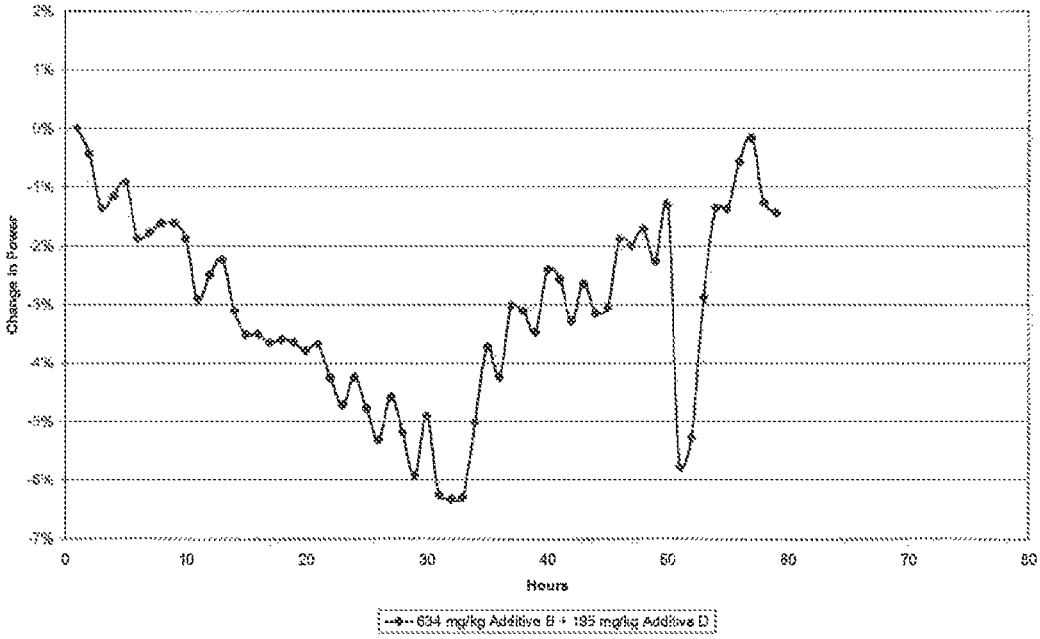
FIG. 5 is a graph showing the power output of an engine using composition 5 in an injector "clean up" test.
Figure 6:
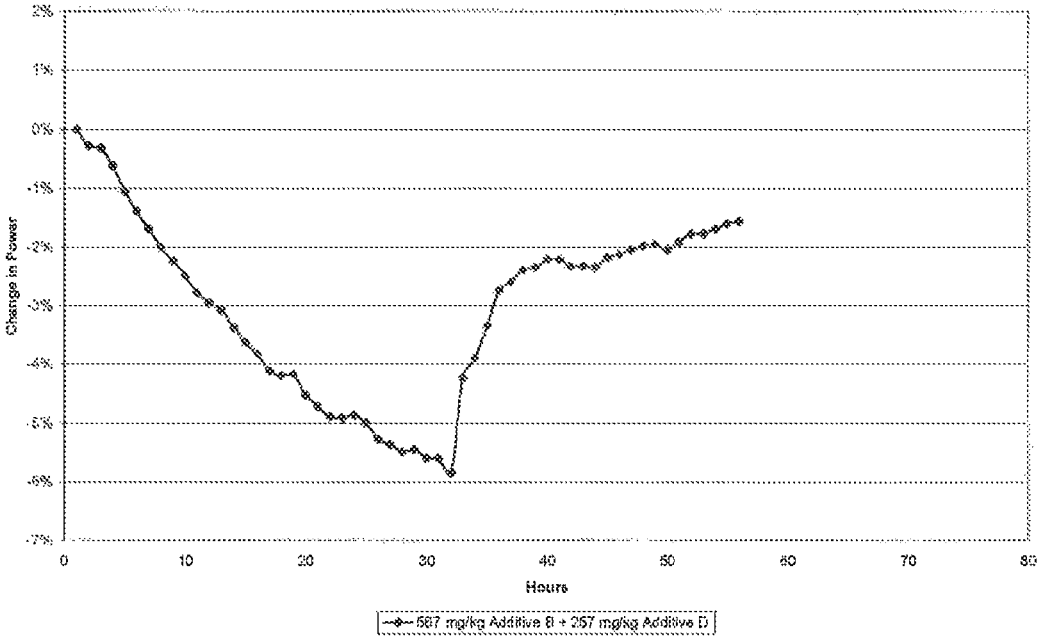
FIG. 6 is a graph showing the power output of an engine using composition 6 in an injector "clean up" test.

Fuel compositions 5 and 6 were tested according to the DW10 test procedure described in example 3. The power output over the test period is shown respectively in FIGS. 5 and 6.

Example 5

Additive E was prepared as follows:

A PIBSA having a PIB molecular weight of 1000 (4822.4 g, 3.93 eq) and Caromax 20 (3439 g) were charged to a reactor and heated under nitrogen to 60° C. Aminoethylethanolamine (367 g, 3.53 eq) was charged and the reactor contents heated to 160° C. Water of reaction was removed.

The diesel fuel compositions shown in table 4 were prepared by adding the specified amounts of additives to RF06 base fuel comprising 1 ppm zinc.

TABLE 4

| Fuel composition | Additive B (ppm active) | Additive E (ppm active) |
|---|---|---|
| 7 | 585 | 60 |
| 8 | 780 | 120 |
| 9 | 567 | 257 |

Figure 7:
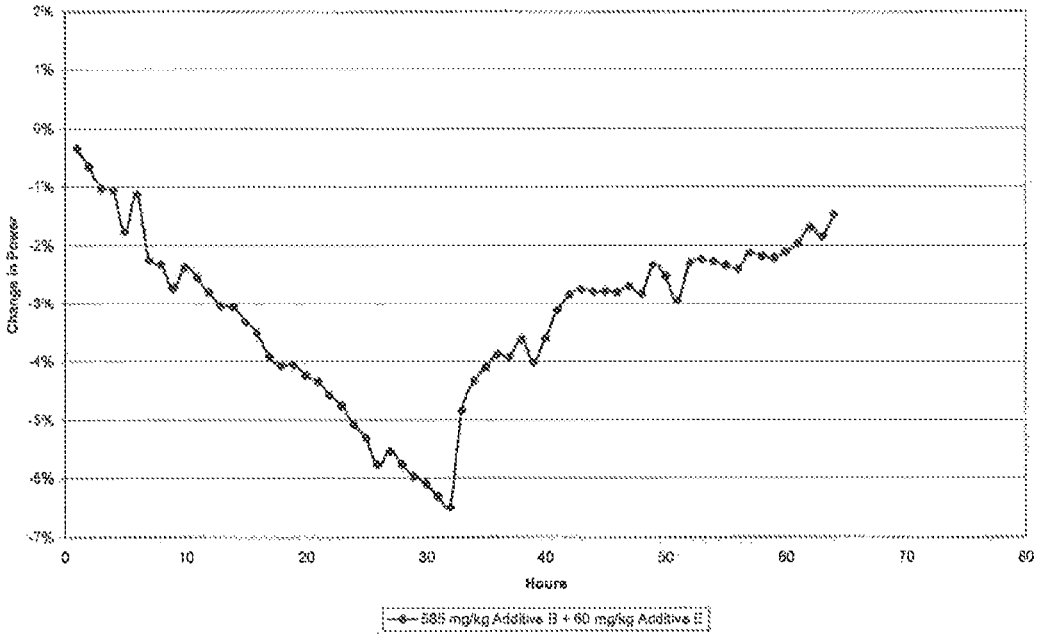
FIG. 7 is a graph showing the power output of an engine using composition 7 in an injector "clean up" test.
Figure 8:
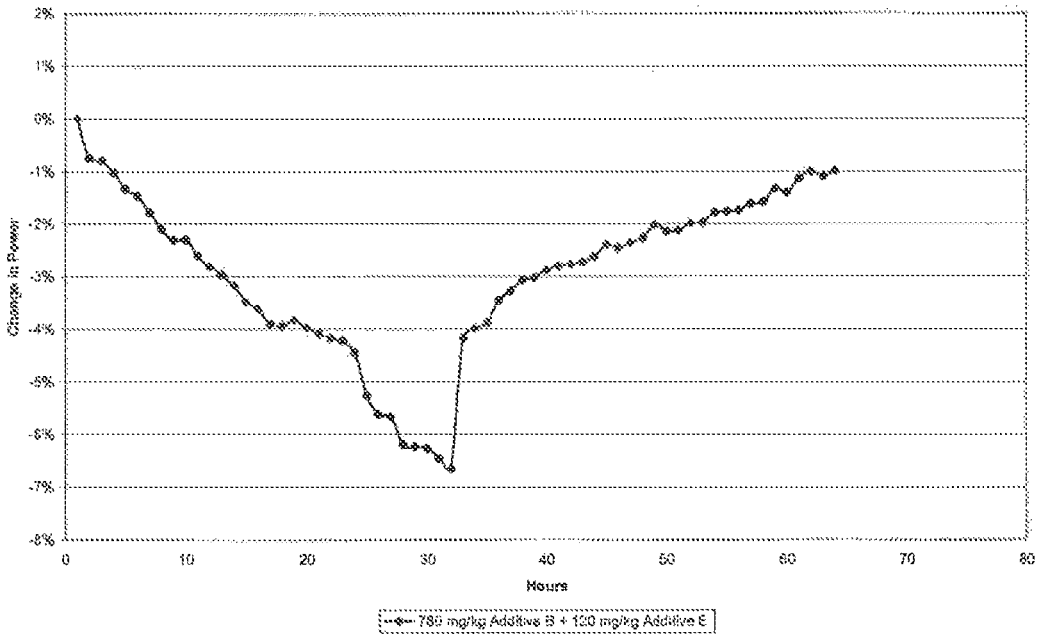
FIG. 8 is a graph showing the power output of an engine using composition 8 in an injector "clean up" test.
Figure 9:
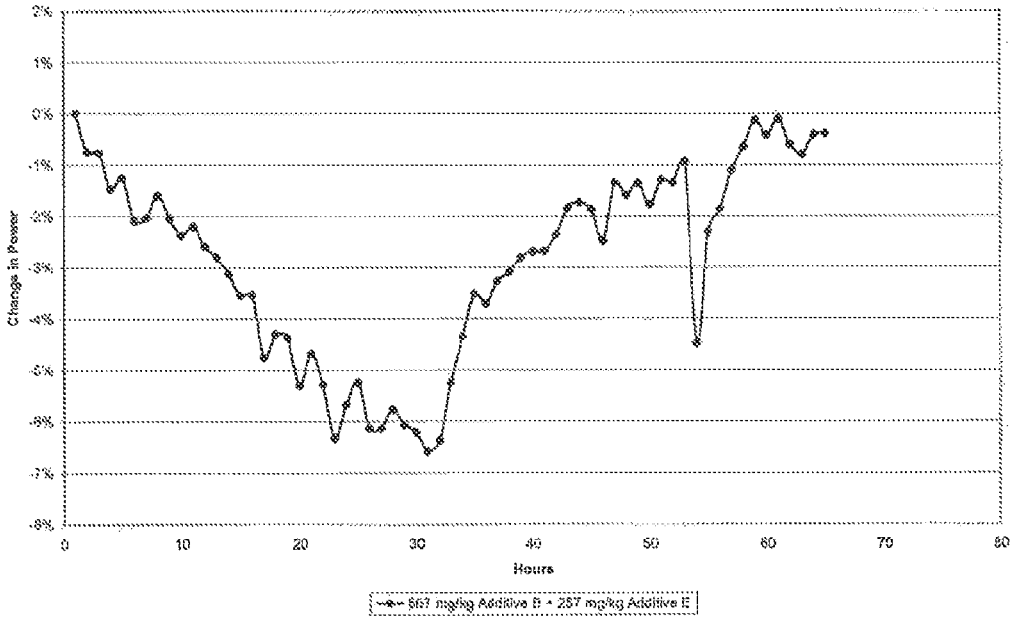
FIG. 9 is a graph showing the power output of an engine using composition 9 in an injector "clean up" test.

Fuel compositions 7, 8 and 9 were tested according to the DW10 test procedure described in example 3. The power output over the test period is shown respectively in FIGS. 7, 8 and 9.

Example 6

Additive F, a quaternary ammonium salt, was prepared as follows:

A PIBSA having a PIB molecular weight of 1000 (3794.8 g, 3.07 eq) and Caromax 20 (2715 g) were charged to a reactor and heated under nitrogen to 60° C. Dimethylamino propylamine (313.76 g, 3.07 eq) was charged and the reactor contents heated to 162° C. Water of reaction (50 g) was removed.

The PIBSI prepared above (687.0 g, 0.62 eq) was charged to a 1 liter reactor with methanol (205.99 g), styrene oxide (37.4 g, 0.31 eq) and acetic acid (18.64 g, 0.31 eq). The contents were stirred and heated to reflux for 5 hours. Methanol was removed under vacuum.

Example 7

Additive G was prepared as follows:

A reactor was charged with dodecylphenol (277.5 kg, 1.06 kmoles), ethylenediamine (43.8 kg, 0.73 kmoles) and Caromax 20 (196.4 kg). The mixture was heated to 90° C. and formaldehyde solution, 36.6 wt % (119.7 kg, 1.46 kmoles) charged over 1 hour. The temperature was increased to 140° C. for 3 hours and water removed under vacuum. In this example the molar ratio of aldehyde(a):amine(b):phenol(c) was approximately 2:1:1.45.

A diesel fuel composition was prepared composition was prepared by adding 133 ppm active additive F and 145 ppm active additive G to RF06 base fuel comprising 1 ppm zinc.

The composition was tested according to the DW10 procedure described in example 3.

Figure 10:
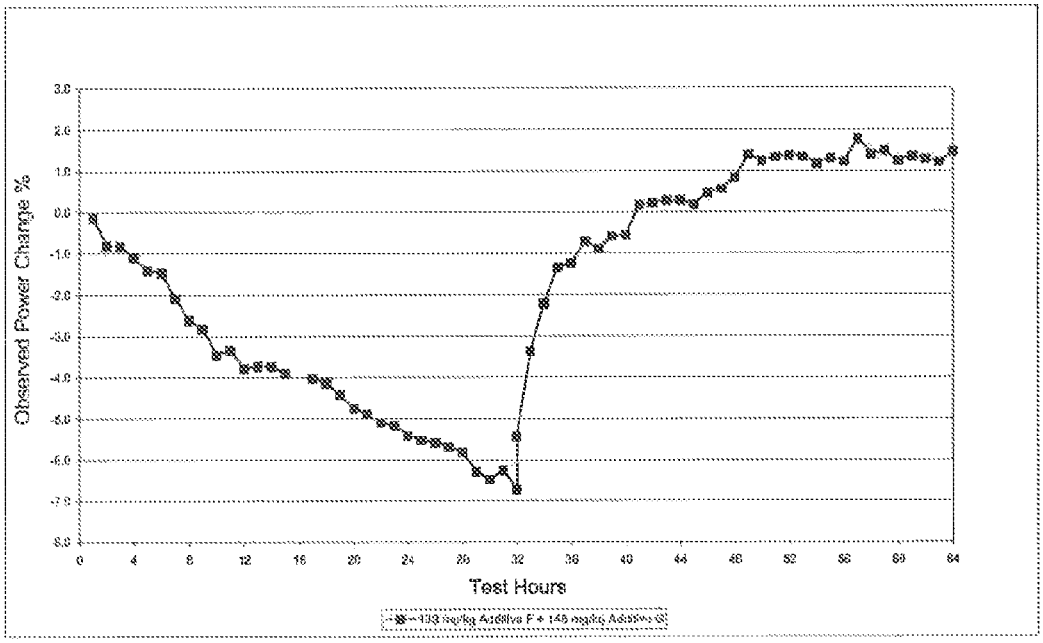
FIG. 10 is a graph showing the power output of an engine using a composition of a mixture of 133 ppm active additive F and 145 ppm active additive G in an injector "clean up" test.

The power output over the test period is shown in FIG. 10.

The invention claimed is:

1. A method of removing deposits from a diesel engine, the method comprising combusting in the engine a diesel fuel composition comprising an engine cleaning additive, wherein the engine cleaning additive is the product of a Mannich reaction between:

(a) an aldehyde;

(b) ammonia, hydrazine or an amine; and (c) an optionally substituted phenol;

wherein the or each substituent of the phenol component (c) has an average molecular weight of less than 400 and wherein the diesel engine has a high pressure fuel system.

2. The method according to claim 1 wherein component (b) is a polyethylene polyamine having from 2 to 8 nitrogen atoms.

3. The method according to claim 1 wherein the engine cleaning additive is present in the diesel fuel composition in an amount of at least 30 ppm.

4. The method according to claim 1 wherein the diesel fuel composition further comprises a quaternary ammonium salt additive formed by the reaction of a nitrogen containing species having at least one tertiary amine group and a quarternizing agent.

5. The method according to claim 4 wherein the nitrogen containing species is selected from the group consisting of:

(i) the reaction product of a hydrocarbyl-substituted acylating agent and a compound comprising at least one tertiary amine group and a primary amine, secondary amine or alcohol group;

(ii) a mannich reaction product comprising a tertiary amine group; and (iii) a polyalkylene substituted amine having at least one tertiary amine group.

6. The method according to claim 4 wherein the quarternising agent is selected from the group consisting of dialkyl sulphates, benzyl halides, hydrocarbyl substituted carbonates, hydrocarbyl epoxides in combination with an acid, and mixtures thereof.

7. The method according to claim 1 wherein the fuel composition further comprises one or more nitrogen-containing detergents.

8. The method according to claim 7 wherein the nitrogen-containing detergent is the reaction product of a hydrocarbyl-substituted carboxylic acid acylating agent and an amine.

9. The method according to claim 1 wherein the fuel composition further comprises a metal-deactivating compound.

10. The method according to claim 1 wherein after running the engine for 24 hours there is an increase in power output of at least 3%.

11. The method according to claim 1 wherein the diesel fuel composition comprises from 0.1 to 10 ppm of a metal containing species.

12. A diesel fuel composition comprising an engine cleaning additive, wherein the engine cleaning additive is the product of a Mannich reaction between:

(a) an aldehyde;

(b) ammonia, hydrazine or an amine; and (c) an optionally substituted phenol;

wherein the or each substituent of the phenol component (c) has an average molecular weight of less than 400.

13. The diesel fuel composition according to claim 12 wherein component (b) is a polyethylene polyamine having from 2 to 8 nitrogen atoms.

14. The diesel fuel composition according to claim 12 wherein the engine cleaning additive is present in the diesel fuel composition in an amount of at least 30 ppm.

15. The diesel fuel composition according to claim 12 further comprising a quaternary ammonium salt additive formed by the reaction of a nitrogen containing species having at least one tertiary amine group and a quarternizing.

16. The diesel fuel composition according to claim 15 wherein the nitrogen containing species is selected from the group consisting of:

(i) the reaction product of a hydrocarbyl-substituted acylating agent and a compound comprising at least one tertiary amine group and a primary amine, secondary amine or alcohol group;

(ii) a mannich reaction product comprising a tertiary amine group; and (ii) a polyalkylene substituted amine having at least one tertiary amine group.

17. The diesel fuel composition according to claim 15 wherein the quarternising agent is selected from the group consisting of dialkyl sulphates, benzyl halides, hydrocarbyl substituted carbonates, hydrocarbyl epoxides in combination with an acid, and mixtures thereof.

18. The diesel fuel composition according to claim 12 further comprising one or more nitrogen-containing detergents.

19. The diesel fuel composition according to claim 18 wherein the nitrogen-containing detergent is the reaction product of a hydrocarbyl-substituted carboxylic acid acylating agent and an amine.

20. The diesel fuel composition according to claim 12 further comprising a metal-deactivating compound.

21. The diesel fuel composition according to claim 12 wherein the diesel fuel composition comprises from 0.1 to 10 ppm of a metal containing species.

* * * * *